US010369404B2

(12) United States Patent
Smith et al.

(10) Patent No.: US 10,369,404 B2
(45) Date of Patent: Aug. 6, 2019

(54) PEDAL ASSEMBLY FOR EXERCISE MACHINE

(71) Applicant: Nautilus, Inc., Vancouver, WA (US)

(72) Inventors: Joshua S. Smith, Portland, OR (US); P J M. Bush, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 281 days.

(21) Appl. No.: 14/986,068

(22) Filed: Dec. 31, 2015

(65) Prior Publication Data

US 2017/0189743 A1 Jul. 6, 2017

(51) Int. Cl.

| | |
|---|---|
| ***A63B 22/06*** | (2006.01) |
| ***A63B 22/00*** | (2006.01) |
| ***A63B 21/00*** | (2006.01) |
| ***A63B 21/02*** | (2006.01) |
| ***A63B 22/20*** | (2006.01) |
| ***A63B 23/08*** | (2006.01) |

(Continued)

(52) U.S. Cl.

CPC ..... *A63B 22/0015* (2013.01); *A63B 21/023* (2013.01); *A63B 21/028* (2013.01); *A63B 21/4034* (2015.10); *A63B 21/4047* (2015.10); *A63B 22/001* (2013.01); *A63B 22/0046* (2013.01); *A63B 22/0664* (2013.01); *A63B 22/203* (2013.01); *A63B 23/08* (2013.01); *A63B 21/0051* (2013.01); *A63B 21/0058* (2013.01); *A63B 21/00069* (2013.01); *A63B 21/0088* (2013.01); *A63B 21/225* (2013.01); *A63B 71/0619* (2013.01); *A63B 2022/0676* (2013.01); *A63B 2071/0694* (2013.01); *A63B 2225/68* (2013.01)

(58) Field of Classification Search

CPC ..... A63B 22/06–22/0694; A63B 21/4034

See application file for complete search history.

(56) References Cited

U.S. PATENT DOCUMENTS

| | | | |
|---|---|---|---|
| 3,563,129 | A | 2/1971 | Cantrell |
| 3,628,791 | A | 12/1971 | Garcia |

(Continued)

FOREIGN PATENT DOCUMENTS

| | | | |
|---|---|---|---|
| CN | 2629764 | Y | 8/2004 |
| CN | 204637443 | U | 9/2015 |

(Continued)

OTHER PUBLICATIONS

NordicTrack E9.5 User Manual, 2012, 36 pages.
NordicTrack E7.7 Power Incline User Manual, 2013, 32 pages.
Spirit Elliptical User Manual, Oct. 1, 2007, 45 pages.

*Primary Examiner* — Stephen R Crow
(74) *Attorney, Agent, or Firm* — Dorsey & Whitney LLP

(57) ABSTRACT

An adjustable pedal assembly for an exercise machine, such as an elliptical trainer, may include a link and a pedal pivotally connected to the link The pedal assembly may further include a damping assembly, which may provide dynamic damping to the pedal during use of the exercise machine. The damping assembly may be adjustable such that a user can select the level of damping. The damping assembly may include at least one resilient member configured to engage the pedal for damping pivotal movement of the pedal, and an actuator operable to selected a level of damping provided to the pedal by the at least one resilient member.

25 Claims, 21 Drawing Sheets

(51) Int. Cl.

| | |
|---|---|
| *A63B 71/06* | (2006.01) |
| *A63B 21/005* | (2006.01) |
| *A63B 21/008* | (2006.01) |
| *A63B 21/22* | (2006.01) |

(56) References Cited

U.S. PATENT DOCUMENTS

| | | | |
|---|---|---|---|
| RE30,758 | E | 10/1981 | Lang |
| 4,502,680 | A | 3/1985 | Blum et al. |
| 5,020,793 | A | 6/1991 | Loane |
| 5,069,445 | A | 12/1991 | Mai |
| 5,147,257 | A | 9/1992 | Loane |
| 5,336,141 | A | 8/1994 | Vittone |
| 5,336,142 | A | 8/1994 | Dalebout et al. |
| 5,449,332 | A | 9/1995 | Hervig |
| 5,499,956 | A | 3/1996 | Habing et al. |
| 5,503,607 | A | 4/1996 | Lo |
| D383,813 | S | 9/1997 | Zoller |
| 5,683,331 | A | 11/1997 | Dalebout |
| 5,690,589 | A | 11/1997 | Rodgers, Jr. |
| 5,749,811 | A | 5/1998 | Wilson |
| 5,921,894 | A | 7/1999 | Eschenbach |
| 6,042,512 | A | 3/2000 | Eschenbach |
| 6,090,014 | A | 7/2000 | Eschenbach |
| 6,123,650 | A | 9/2000 | Birrell et al. |
| 6,132,340 | A | 10/2000 | Wang et al. |
| 6,146,313 | A | 11/2000 | Whan-Tong et al. |
| 6,277,055 | B1 | 8/2001 | Birrell et al. |
| 6,440,042 | B2 | 8/2002 | Eschenbach |
| 6,500,096 | B1 | 12/2002 | Farney |
| 6,783,481 | B2 | 8/2004 | Stearns et al. |
| 6,821,232 | B1 | 11/2004 | Wang et al. |
| 6,849,034 | B2 | 2/2005 | Eschenbach |
| 6,875,160 | B2 | 4/2005 | Watterson et al. |
| 7,037,242 | B2 | 5/2006 | Lo et al. |
| 7,169,087 | B2 | 1/2007 | Ercanbrack et al. |
| 7,207,930 | B2 | 4/2007 | Bonutti |
| 7,276,017 | B2 | 10/2007 | Chen |
| 7,300,387 | B2 | 11/2007 | Wang |
| 7,377,879 | B1 | 5/2008 | Chen |
| 7,425,188 | B2 | 9/2008 | Ercanbrack et al. |
| 7,645,215 | B2 | 1/2010 | Gordon |
| 7,665,388 | B2 | 2/2010 | Chen |
| 7,666,122 | B2 | 2/2010 | Chiles et al. |
| 7,674,205 | B2 | 3/2010 | Dalebout et al. |
| 7,691,035 | B2 | 4/2010 | Chen et al. |
| 7,727,120 | B2 | 6/2010 | Smith |
| 7,803,089 | B2 | 9/2010 | Roimicher et al. |
| 8,079,937 | B2 | 12/2011 | Bedell et al. |
| 8,734,298 | B2 | 5/2014 | Murray |
| 8,808,149 | B2 | 8/2014 | Huang |
| 8,894,549 | B2 | 11/2014 | Colledge |
| 9,259,610 | B2 | 2/2016 | Huang et al. |
| 9,586,086 | B2 | 3/2017 | Dalebout et al. |
| 10,010,756 | B2 | 7/2018 | Watterson |
| 2004/0157706 | A1 | 8/2004 | Miller |
| 2004/0266588 | A1 | 12/2004 | Miller |
| 2007/0072742 | A1 | 3/2007 | Chen |
| 2007/0135268 | A1 | 6/2007 | Wang |
| 2007/0135269 | A1 | 6/2007 | Wang |
| 2007/0219060 | A1 | 9/2007 | Liang |
| 2008/0064571 | A1 | 3/2008 | Lee |
| 2008/0161166 | A1 | 7/2008 | Lo |
| 2008/0280733 | A1 | 11/2008 | Dickie et al. |
| 2010/0152001 | A1 | 6/2010 | Gordon |
| 2011/0275487 | A1* | 11/2011 | Richards ..... A63B 21/0084 482/57 |
| 2014/0051552 | A1* | 2/2014 | Habing ..... A63B 21/154 482/52 |
| 2014/0274574 | A1 | 9/2014 | Shorten et al. |
| 2016/0158595 | A1 | 6/2016 | Dalebout |
| 2016/0296790 | A1* | 10/2016 | Chuang ..... A63B 22/001 |
| 2016/0339288 | A1 | 11/2016 | Li |
| 2017/0216660 | A1 | 8/2017 | Lernihan |
| 2018/0050231 | A1 | 2/2018 | Teal et al. |

FOREIGN PATENT DOCUMENTS

| | | | |
|---|---|---|---|
| KR | 2005/0115148 | A | 12/2005 |
| WO | 2008114292 | A1 | 9/2008 |

* cited by examiner

PEDAL ASSEMBLY FOR EXERCISE MACHINE

TECHNOLOGICAL FIELD

The present disclosure generally relates to exercise machines, and in particular, to pedal assemblies for use on exercise machines.

BACKGROUND

The present disclosure relates generally to exercise equipment and more specifically to adjustable pedal assemblies for exercise machines such as elliptical trainers. An elliptical trainer, also known as cross-trainer, is a type of exercise machine which is adapted to simulate stair climbing, walking, or running while providing a lower impact exercise. Elliptical machines include pedals supporting the user, and the pedals are connected to a drive assembly via linkages which are adapted to guide the user's feet through an elliptical path. The user's foot typically rolls from heel to toe in a manner similar to running as the user's foot traverses the elliptical path. At least a portion of the user's foot typically remains in contact with the pedal throughout the stroke thereby reducing joint impact. Various types of elliptical trainers have been developed and commercialized and improvements in the field may be desirable for continuing to improve the user's experience.

SUMMARY

In accordance with the present disclosure, a pedal assembly for an exercise machine may include a foot link, a foot member pivotally connected to the foot link, at least one resilient member positioned between the foot member and the foot link, and a selector mechanism movable at least between a first position in which the foot member is supported by the at least one resilient member and a second position in which the foot member is not supported by the at least one resilient member. In some examples, the foot member may be a foot plate. In some examples, the selector mechanism may include a selector platform configured to move between the first position and the second position. In some examples, the selector platform may be configured to move in a plane between the first position and the second position. In some examples, the selector platform may be pivotally coupled to the foot member. In some examples, the selector platform may be pivotable about a pivot axis perpendicular to the foot member. In some examples, the selector platform may include a contact side positioned to at least partially contact the foot member during at least a portion of a stroke of the pedal assembly, and an engagement side in contact with the at least one resilient member when the selector platform is in the first position. In some examples, the engagement side may be opposite the contact side. In some examples, the engagement side may include one or more engagement features configured to resist relative movement between the selector platform and the at least one resilient member. In some examples, the at least one resilient member may include a spring and the one or more engagement features may include a seat configured to engage the spring. In some examples, the at least one resilient member may include an elongate member formed of resilient material.

In some examples, the at least one resilient member may include two or more springs. In some examples, the two or more springs may include a first spring and a second spring stiffer than the first spring. In some examples, the two or more springs comprise two or more helical compression springs. In some examples, the two or more springs may include a first spring and a second spring, and the one or more engagement features may include a first seat to resist relative movement between the first spring and the selector platform when the selector platform is in the first position. In some examples, the selector platform may be configured such that the foot member is not supported by the second spring when the selector platform is in the first position. In some examples, the one or more engagement features may include a second seat configured to resist relative movement between the second spring and the selector platform when the selector mechanism is in a third position. In some examples, the engagement side may include a first region configured to engage only one spring of the two or more springs and a second region configured to engage only another one of the two or more springs. In some examples, the first region may be located near a perimeter of the engagement side and the second region may be adjacent to the first region.

In some examples, the at least one resilient member may include a first resilient member and a second resilient member, and the engagement side may include an engagement sector including engagement features to resist relative movement between the selector platform and the first resilient member, the second resilient member, or both. In some examples, the first engagement sector may correspond to the first position, and the pedal assembly may further include a second engagement sector corresponding to a third position in which the selector platform contacts the first resilient member, the second resilient member, or both. In some examples, the springs may be connected to a support structure below the foot member. In some examples, the springs may be removably connected to the support structure. In some examples, the support structure may include a base comprising a plurality of holes sized for an interference fit with the springs. In some examples, the selector platform, the base, or both may be made from a resilient material. In some examples, the base may rest on a bracket attached to the foot link In some examples, the pedal assembly may include a post positioned between the foot member and the support structure and the foot member may rest on the post when the selector platform is in the second position. In some examples, the selector platform may include at least one registration hole configured to receive the post at least partially therein. In some examples, the selector platform may be movable to a plurality of predetermined positions including the first and second positions, and the selector platform may include a registration hole for each of the plurality of predetermined positions, the registration hole configured to receive, at least partially, therein the post. In some examples, the post may include a resilient material at a free end of the post.

In some examples, the pedal assembly may include an actuator connected to the selector platform. In some examples, the actuator may include a knob and a rod, and the knob may be movably coupled to the rod. In some examples, the pedal assembly may include a housing at least partially enclosing the foot member and the selector mechanism. In some examples, the housing may include a first portion movable relative to a second portion of the housing. In some examples, the actuator may be configured to lift a portion of the housing when the selector platform is moved between the first and second positions. In some examples, at least a portion of the actuator projects from the housing. In some examples, the pedal assembly may include an indicator configured to provide visual feedback of a selected position. In some examples, at least a portion of the indicator may be incorporated in the housing. In some examples, the pedal assembly may include a guide plate configured to guide a movement of the actuator. In some examples, the guide plate may include a slot and the actuator may pass through the slot. In some examples, the indicator may be provided on the guide plate.

In accordance with the present disclosure, an exercise machine may include a frame, which may include a base for contacting a support surface, a drive assembly operatively associated with the frame, and first and second reciprocating assemblies operatively coupled to the drive assembly and the frame. Each of the first and second reciprocating assemblies may include a pedal assembly according to any of the examples herein. In some examples, each of the first and second reciprocating assemblies may include a foot link, a pedal pivotally connected to the foot link, and a selector mechanism operatively coupled to the pedal and configured to adjust the pedal from a first configuration in which the pedal is supported by at least one resilient member to a second configuration in which the pedal is not supported by the at least one resilient member. In some examples, the exercise machine may be an elliptical trainer. In some examples, the drive assembly may include a crank shaft located forward of the pedals.

DETAILED DESCRIPTION

The following description of certain exemplary embodiments is merely exemplary in nature and is in no way intended to limit the claimed invention or its applications or uses. In the following detailed description of embodiments of the present assemblies, systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system. Moreover, for the purpose of clarity, detailed descriptions of certain features will not be discussed when they would be apparent to those with skill in the art so as not to obscure the description of the present system. The following detailed description is therefore not to be taken in a limiting sense, and the scope of the present system is defined only by the appended claims.

Figure 1:
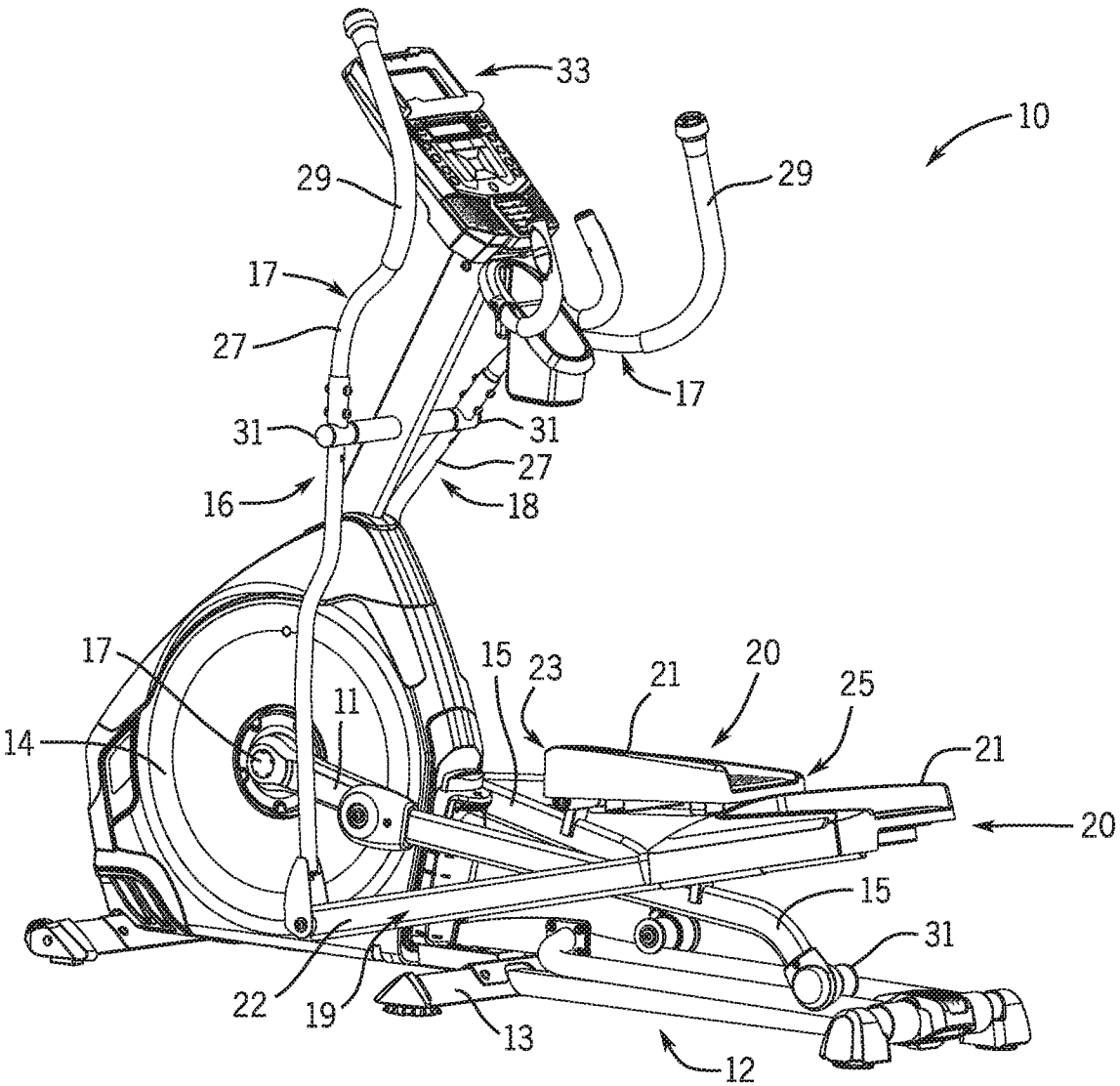
FIG. 1 is an isometric view of an elliptical machine which may incorporate a pedal assembly in accordance with the present disclosure.

FIG. 1 illustrates an exercise machine. The exercise machine 10 may include a frame 12, a drive assembly 14, first and second reciprocating assemblies 16, 18 and a resistance mechanism. The frame 12 may include a base 13 for contact with a support surface. The drive assembly 14 may be connected to the frame 12 and may include a pulley supported on a crank shaft 17 that is joined to crank arms 11, which may extend from the crank shaft in diametrically opposite directions from each other. The pulley may be operably coupled to a flywheel via a belt or other suitable mechanisms. The elliptical machine 10 may be a front-drive (as in the illustrated example), a rear-drive, or a center-drive machine depending on the location of the crank shaft 17, and may include a fixed stride link assembly or a variable stride link assembly. The resistance mechanism, such as an eddy current brake, a motor, or a fan, may be operatively associated with the crank shaft 17 to provide variable resistance to enable different levels of resistance for the user.

The first and second reciprocating assemblies 16, 18 may be operatively coupled to the frame 12 and the drive assembly 14. Each of the first and second reciprocating assemblies 16, 18 may include an arm reciprocating portion 17 and a leg reciprocating portion 19. The arm reciprocating portion 17 may include an arm link 27 and a handle 29 configured to be grasped by the user, the arm link 27 and handle 29 configured to guide reciprocation motion of the user's arms. The arm links 27 may be pivotally joined to the frame, e.g., at pivot joint 31. The pivot joints 31 may be coaxially aligned such that the arm links 27 reciprocate in rotationally opposing motion. The arm links 27 may be pivotally joined to respective leg reciprocating portions 19. The leg reciprocating portion 19 may include a pedal assembly 20 joined to a reciprocating link 15. The pedal assembly 20 and reciprocating link 15 may be configured to support the user's feet in reciprocating motion during use of the machine. The reciprocating link 15 may include a wheel 31 at one end and be pivotally joined to a crank arm 11 at a distal end. The pedal assembly 20 may be pivotally joined to the reciprocating link 15 and to an arm link 27.

Each pedal assembly 20 may include a pedal 21 that a user's foot may engage during use of the exercise machine and a foot link 22 that supports the pedal 21. The toes of the user's foot may be placed near a forward end 23 of the pedal 21 and the heel of the user's foot may be placed near an aft end 25 of the pedal 21. The forward and aft ends 23, 25 of the pedal 21 may thus be interchangeably referred to as toe end and heel end, respectively. In conventional elliptical machines, the pedals are typically rigidly coupled to respective foot links As the user's foot traverses an elliptical path defined by a reciprocating assembly, the user's foot may roll from heel to toe due to typical bio-mechanic principles. Thus, the user's toes may apply a greater pressure than the user's heel during one portion of the stroke, and the user's heel may apply a greater pressure than the user's toes during another portion of the stroke. Elliptical trainers with static pedals may not provide variable support during the different portions of the stroke to match the varying pressures applied by the foot to the pedal throughout the stroke. As such, part of the user's foot (e.g., the toes or the heel) may separate, sometimes repeatedly, from the pedal during a stroke which may decrease the user's comfort and thus motivation to exercise. In addition, because conventional pedals are typically static with respect to the foot links 22, or have a defined motion relative to the foot links, the user may be prone to adapting an ergonomically incorrect exercise form, which may further decrease comfort and ease of use.

The elliptical machine 10 includes dynamic pedals (e.g., pedals 21) in accordance with the present disclosure, which may provide an improved user experience. The term dynamic pedal is generally meant to imply that the pedal is adapted to move relative to the foot link 22 during use. In addition to being dynamic, the pedal assemblies may be configured such that the amount of resistance to (or damping) of the pedal's movement may be selectable by the user. Pedal assemblies in accordance with the present disclosure may accordingly be referred to as adjustable pedal assemblies. The pedal assemblies according to the present disclosure may include a plurality of selectable load settings, each of the load settings in the plurality corresponding to either an engaged position in which damping is provided or a disengaged position in which no damping is provided.

FIGS. 2-11 show an adjustable pedal assembly according to a first embodiment. The pedal assembly 100 may be part of an exercise machine, such as the elliptical machine 10 illustrated in FIG. 1. That is the pedal assembly 20 of elliptical machine 10 may be implemented as the pedal assembly 100 or as a pedal assembly according to any of the embodiments of the present disclosure.

Figure 2:
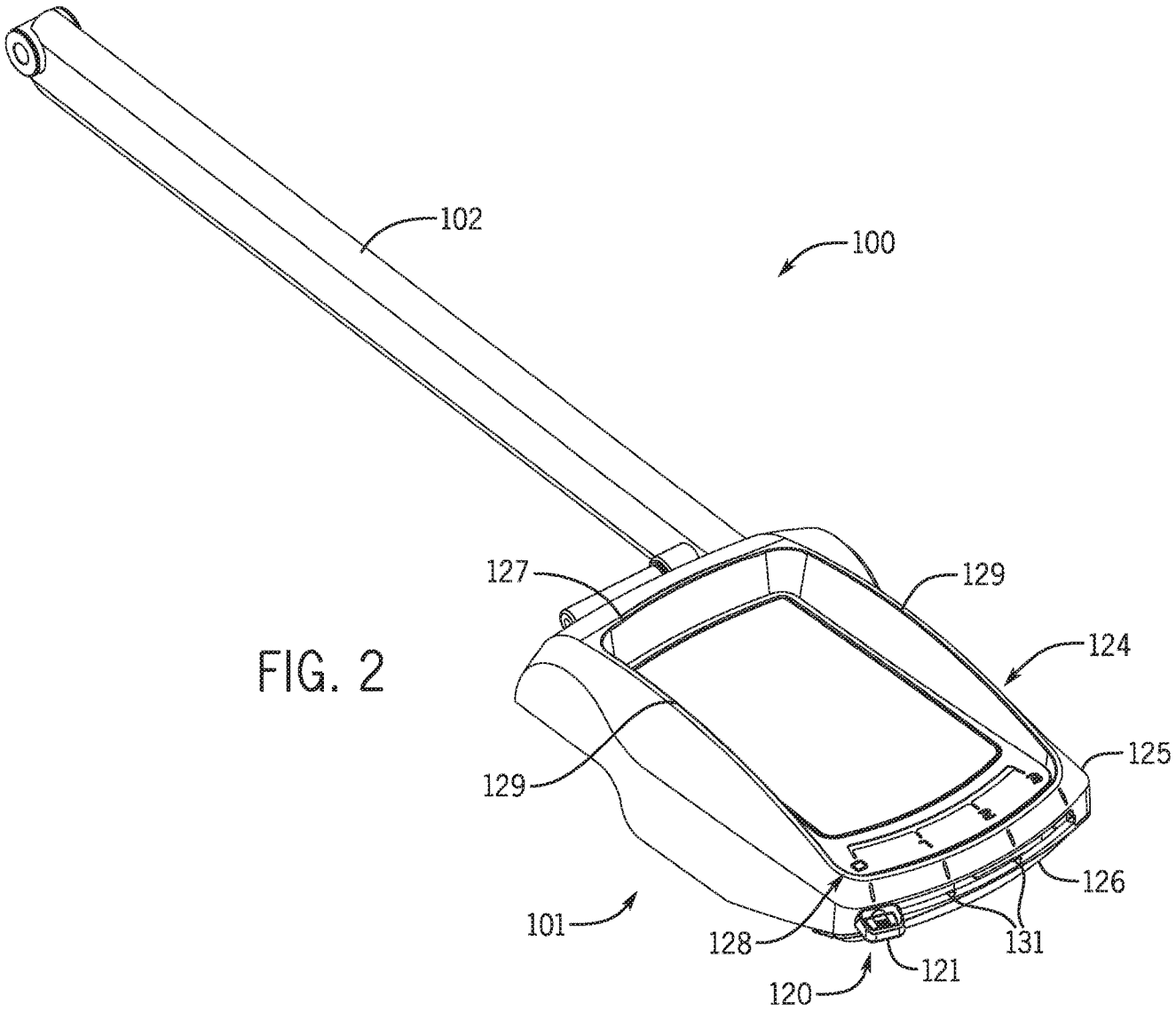
FIG. 2 is an isometric view of a pedal assembly positioned on a link member of an elliptical machine according to a first embodiment of the present disclosure.
Figure 3:
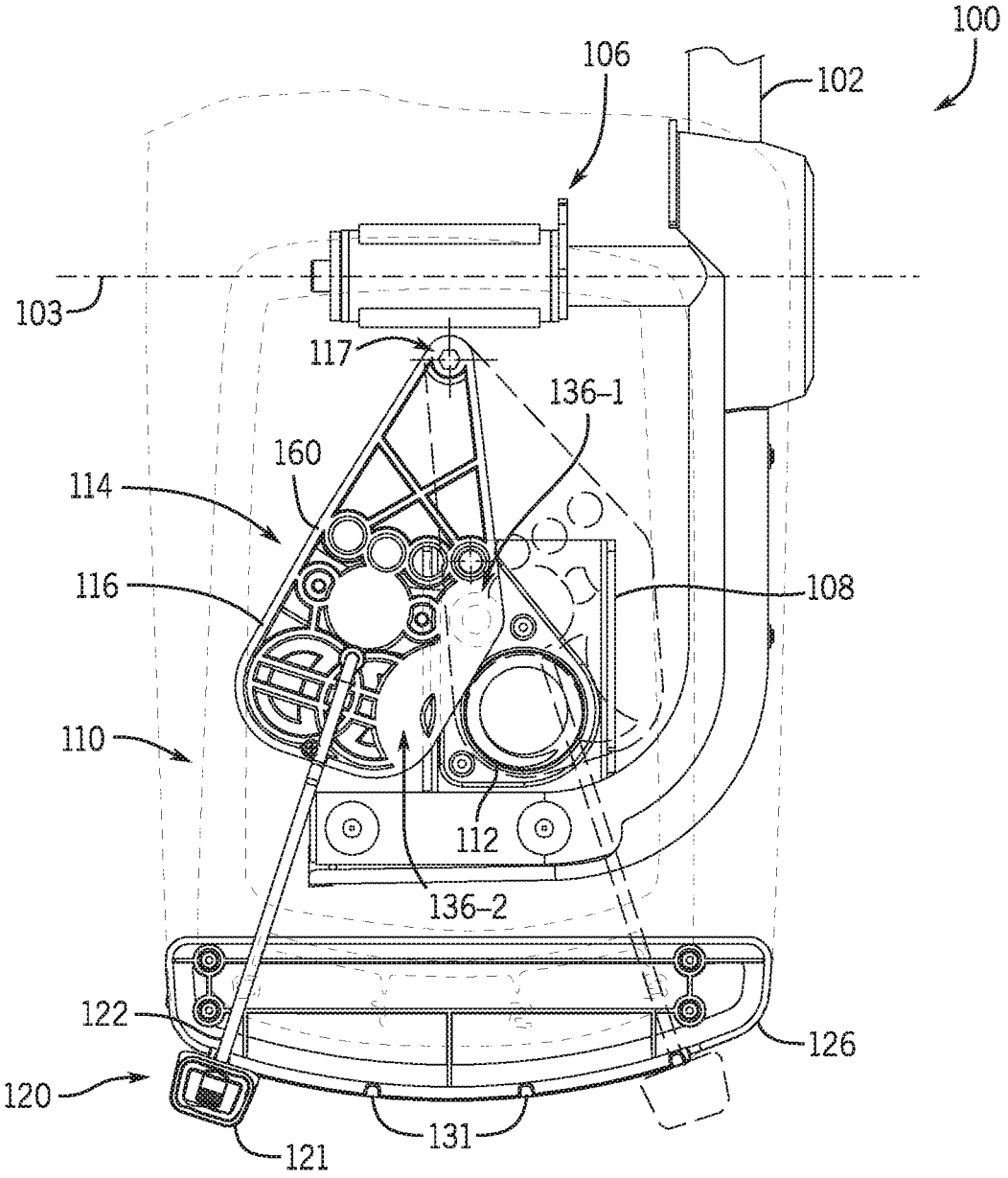
FIG. 3 is a partial top view of the pedal assembly in FIG. 2.
Figure 4:
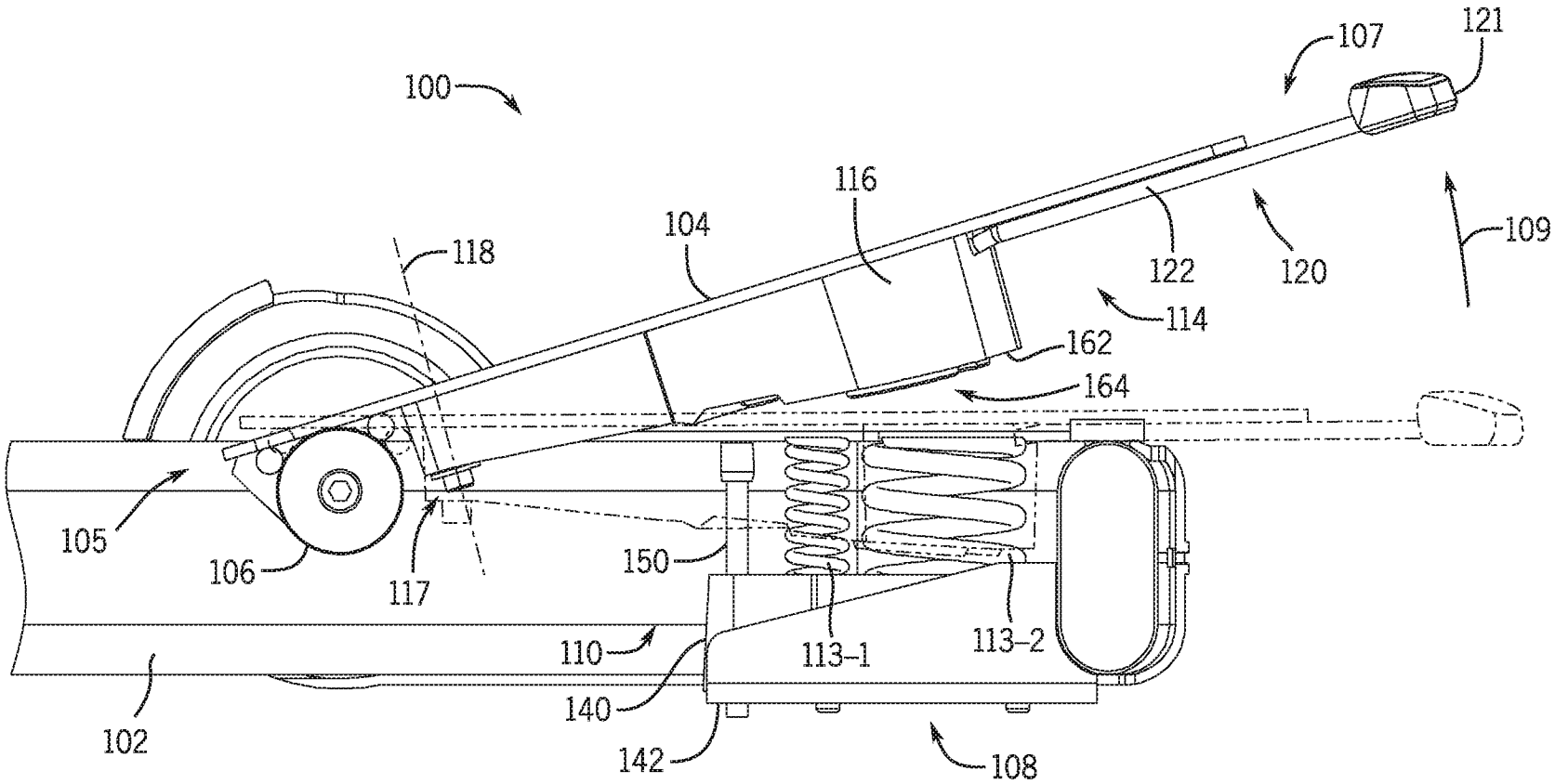
FIG. 4 is a partial side view of the pedal assembly in FIG. 2, showing the foot plate in a raised position and in a use position (in dash)

Referring to FIGS. 2-4, the pedal assembly 100 may include a foot link 102, a pedal 101, a resilience mechanism, and a selection mechanism. The pedal 101 may be pivotally coupled to the foot link 102. The pedal 101 may include a foot member 104, which may take the form of a plate or the like, and a housing. In some examples, the foot member may be integral with the housing or a portion thereof. The foot member may be pivotally connected to the foot link 102 via a pivot joint 106. The pivot joint 106 may include one or more cylindrical bearings arranged relative to the foot link 102, and in one example the arrangement may be perpendicular to a longitudinal axis of the foot link 102 so the motion of the foot plate 104 is at least in part rectilinear relative to the foot link 102. Other arrangements may also be utilized. Where arranged perpendicular to the foot link 102, a pivot axis 103 of the pivot joint 106 is generally perpendicular to the foot link 102. The pivot joint 106 may be located near a forward end 105 of the foot member 104 such that the aft end 107 of the foot member 104 is movable up and down relative to the foot link 102. In other examples, the pivot joint may be located near the aft end of the foot member or other intermediate locations along the foot member. In the illustrated embodiment, when the user's feet are placed on the pedal during use, the user's toes are near the forward end 105 and the user's heels are near the aft end 107 of each foot member. The forward end 105 and aft end 107 of the foot member 104 may thus be interchangeably referred to as toe end and aft end.

Figure 5:
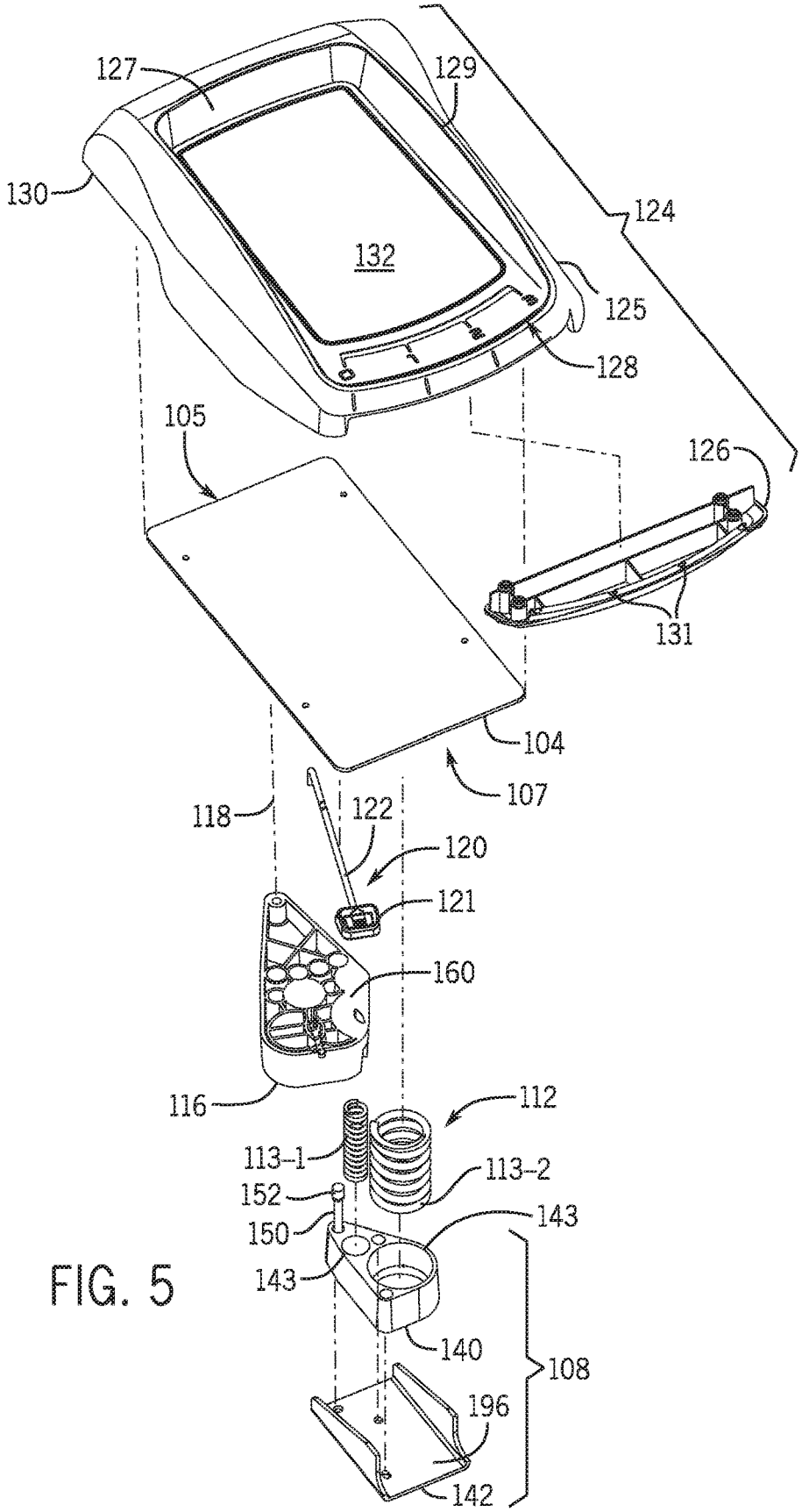
FIG. 5 is a simplified exploded upper isometric view of the pedal assembly in FIG. 2.
Figure 6:
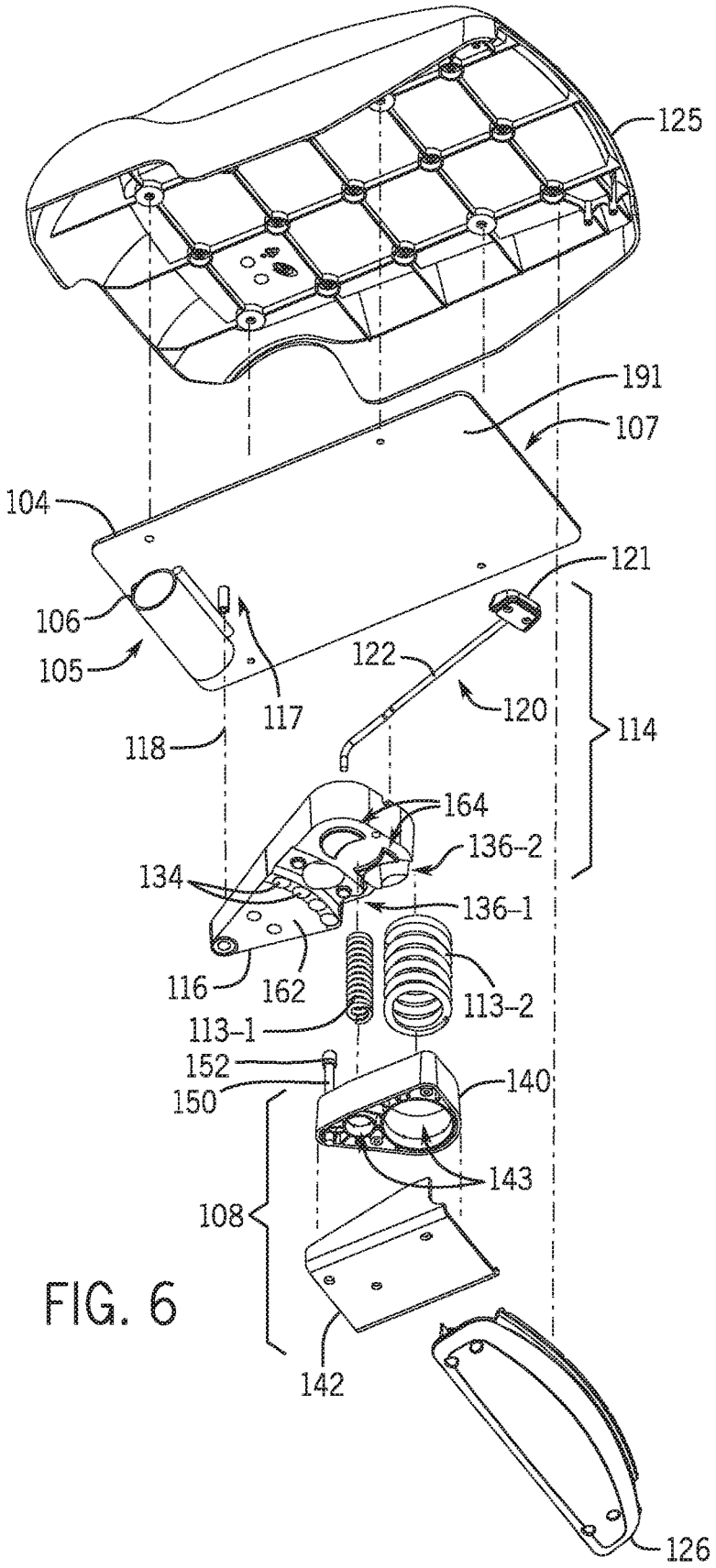
FIG. 6 is simplified exploded lower isometric view of the pedal assembly in FIG. 2.

In a neutral position (i.e., when the foot member is not being adjusted), the foot member 104 rests on a support structure 108 (see e.g., FIGS. 5 and 6). The support structure 108 may be connected to or integral with the foot link 102. In a neutral position, when damping is disengaged, the foot member 104 may be generally parallel with the foot link 102. In an adjustment position (i.e., during adjustment of the pedal, e.g., as shown in FIG. 4), the foot member 104 may be pivoted upward (e.g., in the direction indicated by arrow 109) in order to allow positioning with respect to a user-selectable load setting before returning the foot member 104 to its neutral position. A hard stop may be operatively provided with the pivot joint 106 to limit pivotal movement of the foot member 104 in the upward direction. In some examples, the pivotal movement of the foot member 104 in the upward direction may be limited at about 45 degrees of rotation about the pivot axis 103. An adjustment position may be any position to which the foot member is pivoted between the neutral position, which may correspond to a 0 degree of rotation, and the hard stop limited position. Downward pivotal motion of the pedal (e.g., due to compressive forces resulting from the user's weight) may be damped or resisted by a damping assembly.

The resilience mechanism may take the form of an adjustable damping assembly 110. The adjustable damping assembly 110 includes at least one resilient member 112 positioned between the pedal 101 and the support structure 108. In one example, the resilient member 112 may be a spring. In other examples, elongate or rounded members made from resilient materials, such as rubber, may be used, for example as illustrated in FIGS. 13 and 14. In some examples, the adjustable damping assembly 110 includes a plurality of resilient members 112, for example 2, 3, 4, 5, 6 or more resilient members. The plurality of resilient members may be arranged such that the springs individually or in combinations provide different levels of damping. The pedal assembly 100 of this illustrated embodiment includes two resilient members in the form of compression springs 113-1 and 113-2, e.g., as shown in FIGS. 4-6. The springs 113-1 and 113-2 may have different stiffnesses (i.e., different spring constants). One of the springs, for example a first spring 113-1, may have a first stiffness and another one of the springs, for example a second spring 113-2, may have a second stiffness higher than the first stiffness. The first spring 113-1 may be referred to as light spring and the second spring 113-2 may be referred to as heavy spring. The springs 113-1 and 113-2 may be arranged to provide at least three engaged positions as will be further described.

A housing 124 may enclose at least a portion of the foot member 104 and adjustable damping assembly 110. The housing 124 may include first and second housing portions 125, 126, respectively, which may be movable relative to one another. For example, the first housing portion 125 may be provided to cover at least a portion of the foot member and may thus be interchangeably referred to as top housing portion. The first housing portion 125 may be connected to the foot member 104 and movable with the foot member 104. In this regard, when the foot member 104 is raised and lowered, for example during adjustment of the pedal 101, the first housing portion 125 is raised and lowered with the foot member 104. The housing 125 may include sidewalls that extend downwardly from foot member 104 to cover the damping assembly when in use and the foot member is at its highest angular position. The second housing portion 126 (see e.g., FIGS. 1, 2, and 5) may be provided, at least partially, below the foot member 104 and may thus be interchangeably referred to as a bottom housing portion. The second housing portion 126 may be connected to the support structure 108 and configured to remain stationary during adjustment of the pedal 101. The housing 124 may include a wall 127 provided in a forward portion of the pedal 101. The wall 127 in this example extends upwardly and is configured to prevent the user's foot from sliding forwardly past the perimeter of the pedal 101. In some examples, the housing may, additionally or alternatively, include one or more sidewalls 129, which may restrain lateral movement of the user's foot.

The housing 124 may include an indicator 128 for providing visual feedback to the user of the selected level of damping. The indicator 128 may include markings, engravings or the like, which indicate the selectable load settings available to the user. Each load setting may correspond to one of a plurality of damping levels selectable via the selector mechanism 114. The indicator 128 may be incorporated into the housing 124 or operatively coupled thereto. For example, a plurality of markings may be provided on the top housing portion 125. In some examples, the top housing portion 125 may include two or more separable components, such as a fairing component 130 and an indicator plate 132. The fairing component 130 may include the vertical wall 127 and/or side walls 129. The indicator plate 132 may incorporate the indicator 128. The indicator plate 132 and fairing component 130 may be attached using conventional fasteners. In some examples the indicator 128 may be incorporated into a component separate from the housing 124, such as an electronic component incorporated in a display of the exercise machine (e.g., display 33 of exercise machine 10).

As best seen in FIGS. 3 and 4, the adjustable damping assembly 110 may include a selector mechanism 114. The selector mechanism 114 may include a selector platform 116 movably connected to the foot member 104 to selectively adjust the damping level provided by the one or more resilient members 112. In this illustrated embodiment, the selector platform 116 is pivotally connected to the foot member 104 via a pivot joint 117, which includes a pivot axis 118 that may be generally perpendicular relative to a user support surface of the foot member 104. In this embodiment, the pivot axis 118 is arranged relative to the foot member so that the selector platform 116 is movable in a plane that is generally parallel to a plane of the foot member 104. In some examples, the pivot joint 117 may be implemented as a simple pin joint. In some examples, the pivot joint 117 may include one or more bearings, such as one or more cylindrical bearings. In other examples, the selector platform may instead be slidably engaged with the foot plate such that the selector platform is operable to slide in a plane, for example in a lateral or in a longitudinal direction, to adjust damping of the pedal 101. The selector platform 116 is movable between a disengaged position and at least one engaged position. In the disengaged position, the foot member 104 is not supported by a resilient member 112 but is instead engaged with a fixed, non-compressible member that does not provide damping. In the engaged position, the foot member 104 is supported by at least one resilient member 112 to provide a selected level of damping of downward pivotal movement.

The selector platform 116 may have one of many regular or irregular shapes. In some example, the selector platform 116 may be shaped such that it does not extend beyond or substantially beyond the perimeter of the foot member 104 regardless of the position of the selector platform 116, e.g., as shown in FIG. 3. That is, the selector platform 116 may have a shape selected to substantially fit within a perimeter defined by the foot member regardless of the position of the selector platform 116. In some examples, the selector platform 116 may not extend beyond a perimeter of the foot member 104 and/or interfere with the housing positioned around the foot member 104. In this illustrated embodiment (see e.g., FIG. 7), the selector platform 116 has a generally triangular shape with a portion near one of the vertices removed. Shaping the selector platform 116 in this manner may allow the selector platform to remain substantially below the foot member and thus hidden from view regardless of the selected position. In other examples, the selector platform 116 may be shaped such that it extends beyond the perimeter of the foot member. The pivot axis 118 is arranged proximate a vertex 193 of the triangular platform and a base 195 of the triangular selector platform 116 is proximate to the aft end 107 of the foot member 104. The selector platform 116 is configured to swing through an arc, as illustrated in solid and dashed line in FIG. 3. In some examples, the arcuate motion of the selector platform 116 may be limited by interior sidewalls of the housing 124.

The selector platform 116 may include one or more regions 190, which may include engagement features for engaging one or more components of the underlying structure, such as one or more of the resilient members 112 and/or a post 150. For example, the selector platform 116 may include a first region 190-1 which includes engagement features 164 configured to engage the first resilient member 113-1, and a second region 190-2 which includes engagement features 164 configured to engage the second resilient member 113-2. Each of the regions 190 may be configured to engage only one resilient member of the plurality of resilient members. For example, the first region 190-1 may be configured to only engage the first spring 113-1 and the second region 190-2 may be configured to engage only the second spring 113-2. The selector platform 116 may include additional regions configured to engage additional resilient members, if present, or the post 150. The regions 190 may be arranged at different locations along a radial dimension of the selector platform 116. For example, the second region 190-2 may be proximate the base 195 of the triangular selector platform and the first region 190-1 may be radially inward from the first region towards the vertex 193. In other examples, the regions may be arranged in a different pattern as may be suitable to enable alignment of engagement features on the movable selector platform with resilient members, which may be provided on the fixed frame of the machine.

Figure 7:
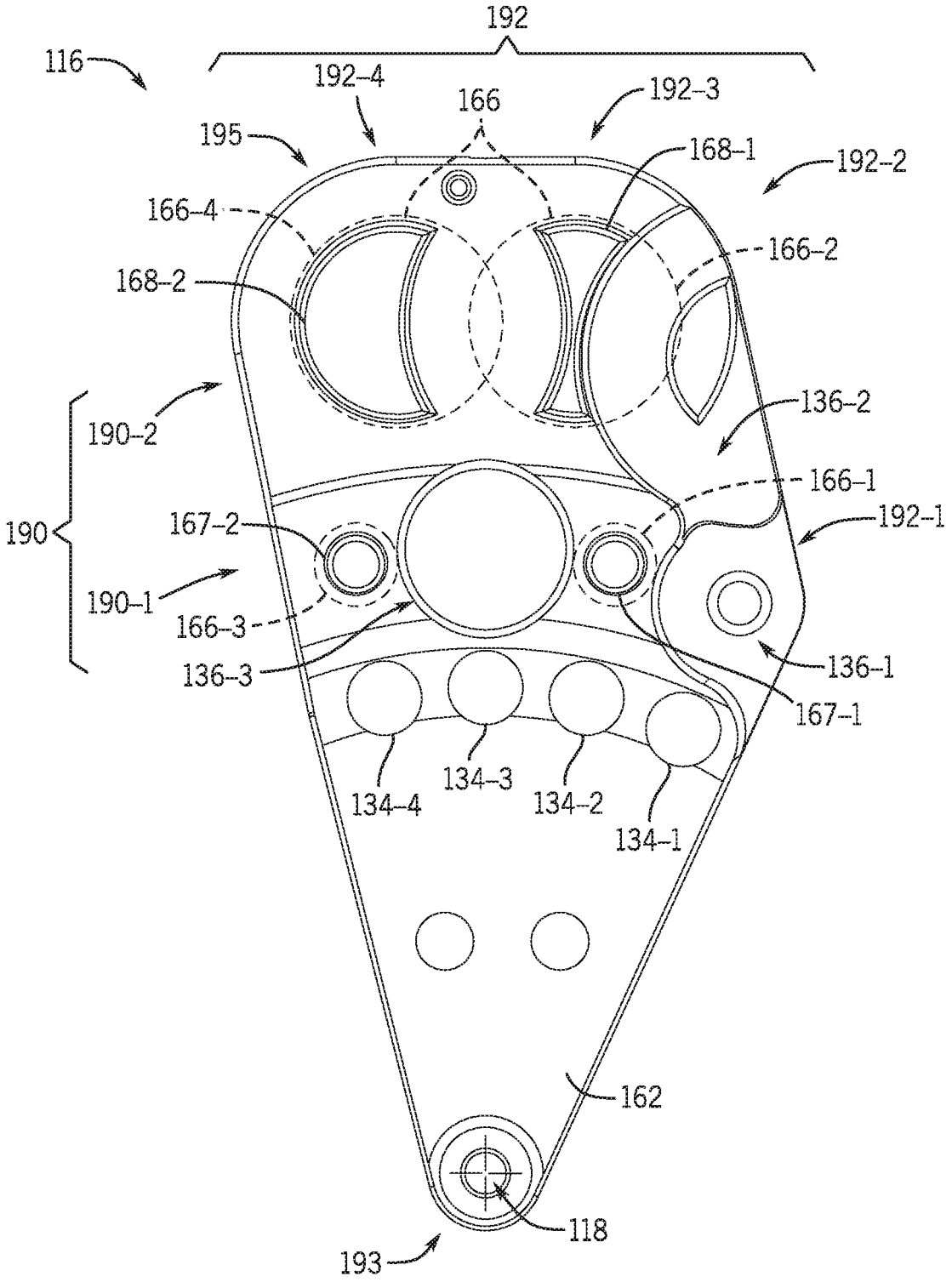
FIG. 7 is a plan view of a selector platform in accordance with the present disclosure, showing engagement features of the selector platform.

The selector platform 116 may include a contact side 160 (FIGS. 3 and 5) and an engagement side 162 (FIGS. 4, 6, and 7). The contact side 160 is adjacent a bottom surface 191 of the foot member. The selector platform 116 is arranged such that at least a portion of the contact side 160 engages, either by direct or indirect contact, the bottom surface 191 of the foot member 104 during at least a portion of a stroke of the pedal assembly 100. The engagement side 162 faces away from the bottom surface of the foot member and is opposite the contact side 160. At least a portion of the engagement side 162 contacts the at least one resilient member 112 when the selector platform 116 is in an engaged position. As best seen in FIG. 7, the engagement side 162 may include one or more engagement features 164. The engagement features 164 may be configured to engage one or more resilient members 112 and resist relative movement between the selector platform 116 and the at least one resilient member 112 during use (as shown in FIGS. 4, and 8-11). The engagement features 164 may define one or more seats 166 configured to engage a corresponding component of the underlying structure, for example a corresponding resilient member 112 or the post 150. The engagement features 164 may include regularly or irregularly shaped protrusions and regularly or irregularly shaped apertures or cavities, as examples. In some examples, a plurality of engagement features 164 may define a single seat, as described below with reference to FIG. 9-11. The one or more engagement features which define a seat for a particular resilient member may be arranged in a respective region 190 as previously described. The one or more engagement features which define seats associated with a particular selectable setting may be arranged in a corresponding sector 192 which is associated with that particular selectable setting.

One or more of the engagement features 164 may be arranged in sectors 192, each sector corresponding to a selectable load setting. For example, the features 164 associated with a first setting may be provided in a first sector 192-1, the features 164 associated with a second setting may be provided in a second sector 192-2, the features 164 associated with a third setting may be provided in a third sector 192-3, the features 164 associated with a fourth setting may be provided in a fourth sector 192-4, and so on. In this regard, each sector may include one or more seats, each configured to engage one or more of the resilient members and/or the post 150. The sectors 192 may be arranged in a radial pattern (e.g., moving from one side of the triangular platform 116 towards another side of the triangular platform 116) along the engagement surface 162, as shown in FIG. 7. Fewer or greater number of sectors may be provided in other embodiments than the number of sectors in the illustrated example.

Referring back to FIGS. 4-6, each resilient member 112 may be fixedly or removably attached to the support structure 108. For example, a resilient member 112 may be fastened to the support structure 108 using conventional fasteners, such as bolts, clips, adhesives, press-fit engagements or the like. In some examples, one or more of the resilient members 112 may be removably attached to facilitate maintenance or replacement. In the illustrated example, each resilient member 112 is implemented in the form of a compression spring 113-1, 113-2.

The support structure 108 may include a base 140 supported on a bracket 142. The bracket may be attached to or integral with the foot link 102. The base 140 may be attached to the bracket 142 via conventional fasteners. The springs 113-1, 113-2 may be attached to the support structure 108 via the base 140 and respective mounts 143 on the base 140. For example, the base 140 may define a respective number of apertures which may serve as the mounts 143, and the springs may be inserted and retained in the holes, e.g., by friction. The base 140 may be formed from a resilient material, such as high durometer rubber, and the receptacles may be sized for an interference fit with the springs 113-1, 113-2. The size of the mounts 143 (e.g., depth of the apertures) may be selected to provide sufficient lateral stability and/or friction force to retain the springs 113-1, 113-2. The apertures may be through-holes (as in the illustrated examples) and the bottoms of the springs may extend to and abut a top surface 196 of the bracket 142. One or more of the springs 113-1, 113-2 may be removable from the base 140, for example for replacement. In some examples, the springs 113-1, 113-2 may additionally or alternatively be fastened to the base 140 or bracket 142 to ensure that the springs do not decouple from the support structure 108 during use.

The adjustable damping assembly 110 may include a post 150. The post 150 may be configured to contact the foot member 104 in the disengaged position. In such embodiments, the post 150 may assist in supporting the foot member 104 in the disengaged position. In some examples, the post 150 does not support the foot member 104 in the disengaged position and the foot member 104 may instead rest against the foot link 102 or another component attached to the foot link such that the foot member 104 is in a neutral (0 degree orientation) position). In such examples, the post 150 may maintain the selector platform in an alignment which corresponds to the disengaged position. In the illustrated example, the post 150 is attached to the supporting structure 108. In other examples, the post 150 may be operatively provided elsewhere on the pedal assembly.

The post 150 may be an elongate member, such as a pin, made from a rigid material such as metal. The pin may have a length equal or slightly greater than the length of the uncompressed springs. The post may include a resilient end 152. The resilient end 152 may be implemented as a rubber cap or rubber coating provided on the free end of the pin. The resilient end 152 (e.g., a cap or a coating) may be relatively thin and would not otherwise impart damping when in the disengaged position. The resilient end 152 on the post 150 may reduce mechanical noise which may otherwise result from repetitive contact between the foot member 104 and the post 150 during use of the machine but may not otherwise materially allow the foot member to pivot relative to the foot link The selector mechanism 114 may include an actuator 120 connected to the selector platform 116. The actuator 120 is used by a user to select a desired load setting, and is configured to allow the user to move the selector platform 116 and/or foot member 104 to a desired location. The actuator 120 may be implemented in the form of a rod 122 connected to the selector platform 116. A knob 121 may be provided at the free end of the rod 122. The knob 121 may extend beyond the aft end 107 of the foot member 104 and/or pedal 101. The rod 122 and knob 121 may be rigidly coupled to the selector platform 116. In order to select a desired level of damping, the user may grasp the knob and apply a moving force to the selector platform 116, and allow the user to select one of a plurality of predetermined positions including the disengaged position and any of the one or more engaged positions. In some examples, the actuator 120 may operate in conjunction with the markings to function as the indicator 128. For example, the rod 122 may align with one of the load settings when the selector platform 116 is moved to a predetermined position thereby providing visual feedback of the selected position. In some examples, one or more detents 131 are provided, for example on the housing 124, which detents 131 may provide a tactile guide for aligning the rod 122 with the load settings.

Figure 8:
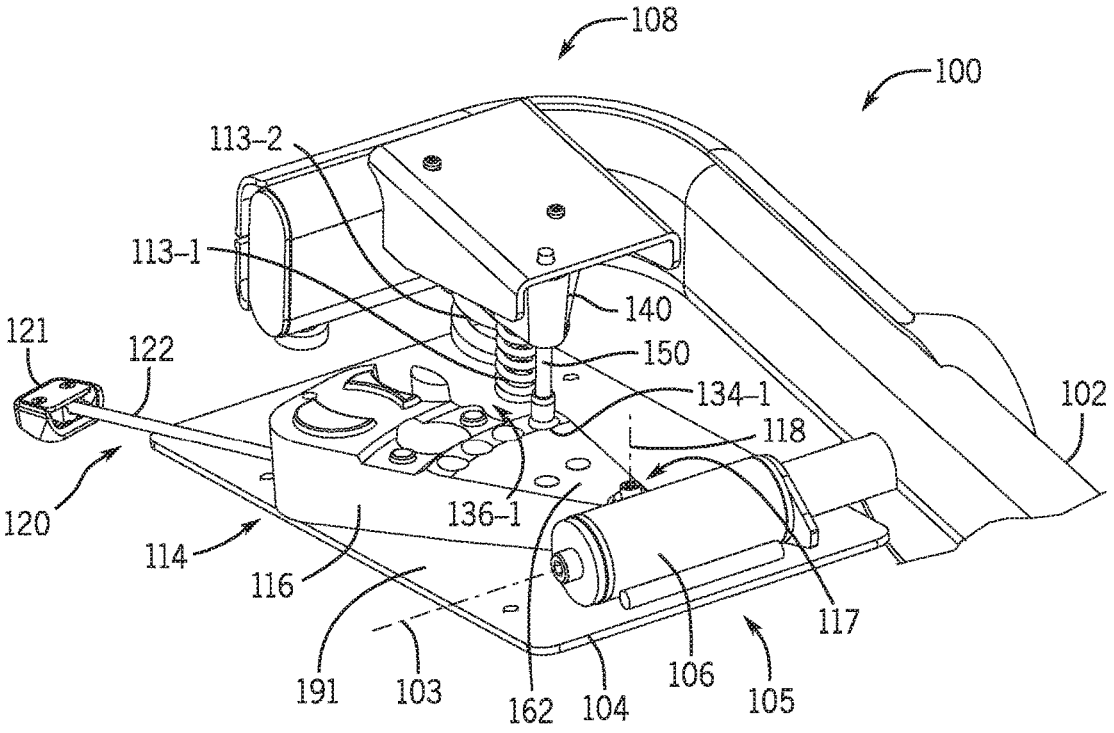
FIGS. 8-11 are partial simplified isometric views of the pedal assembly in FIG. 2.
Figure 9:
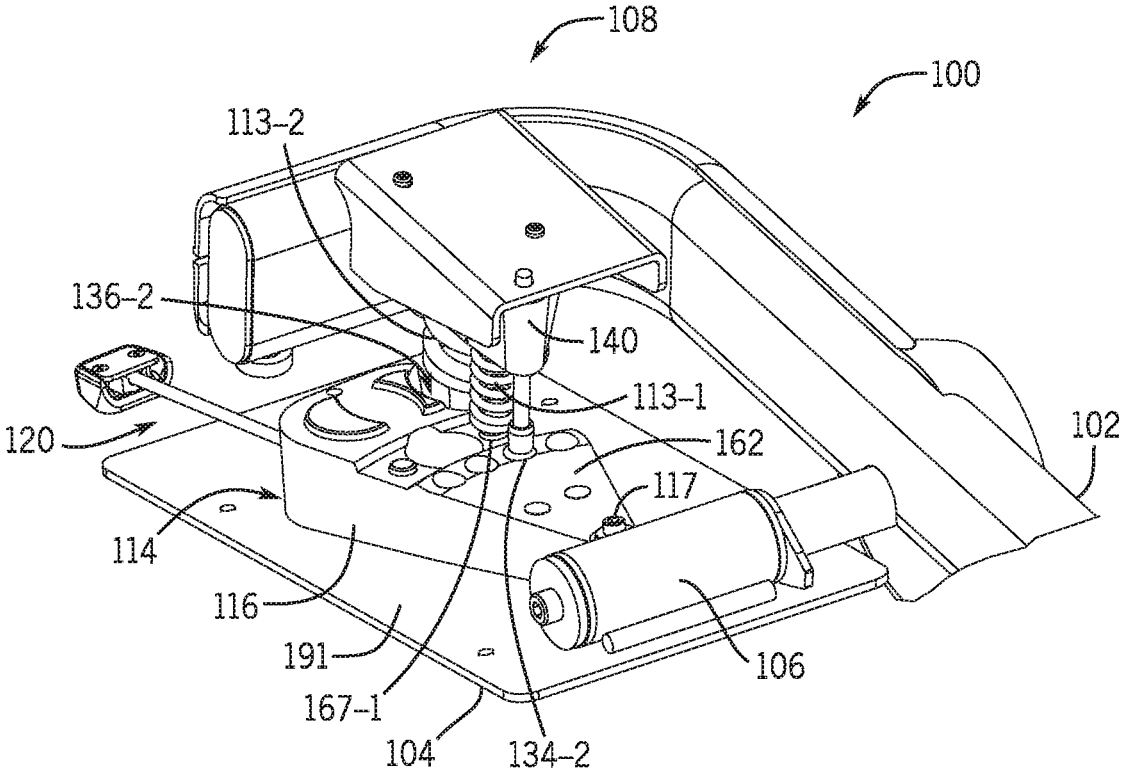
Figure 10:
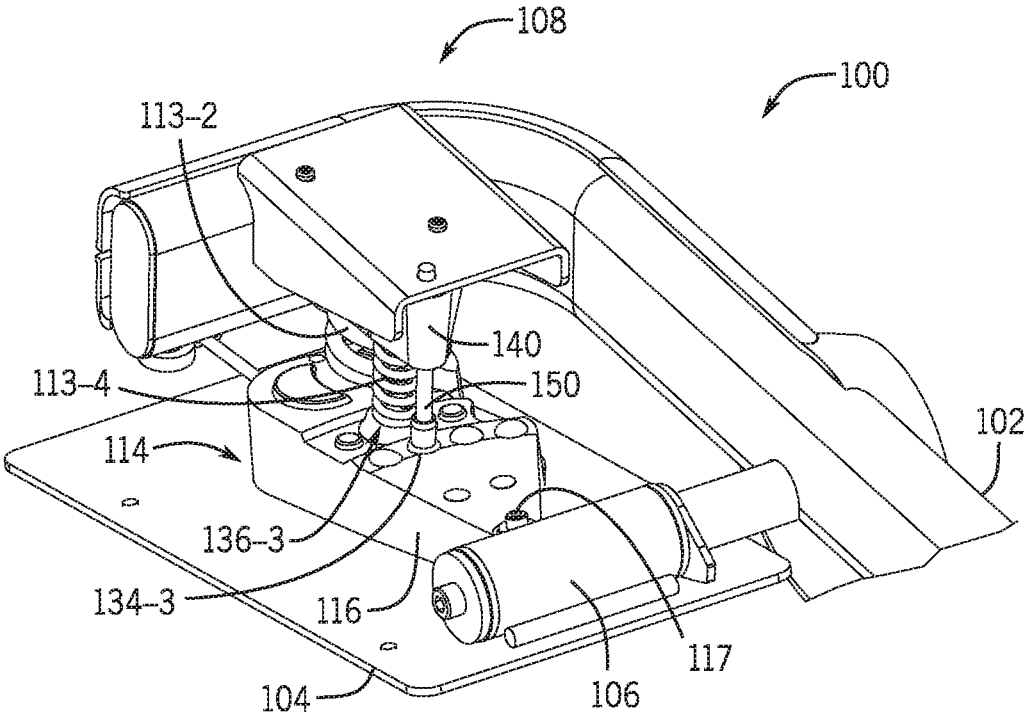
Figure 11:
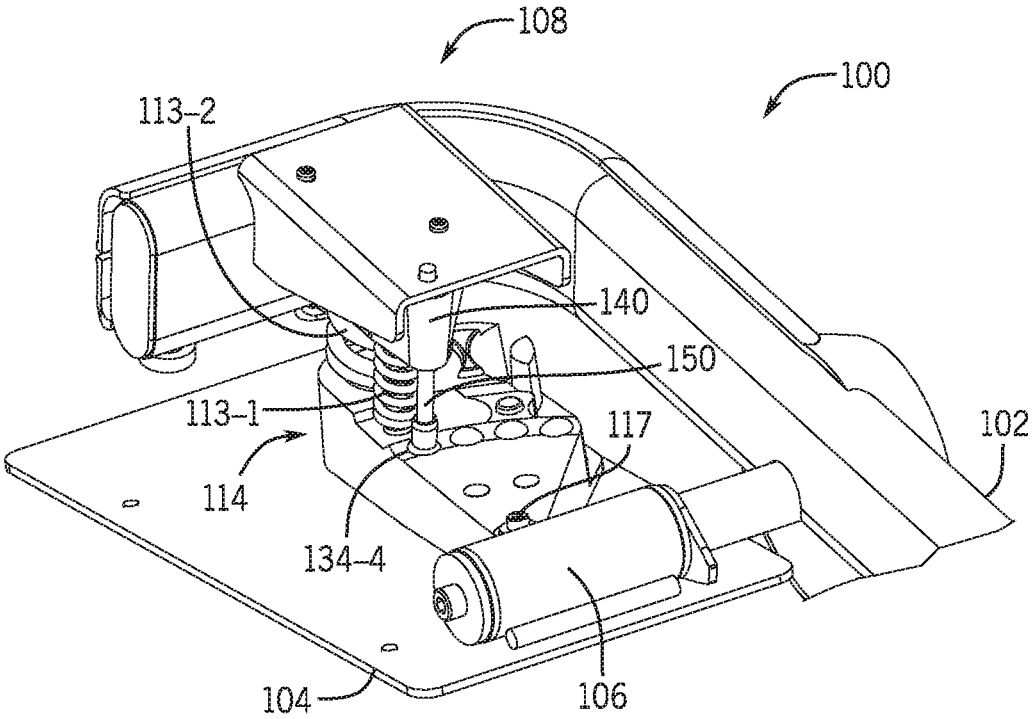

Operation of the adjustable damping assembly 110 will now be described in further detail with further reference to FIG. 7 and also with reference now to FIGS. 8-11, which show partial isometric views of the bottom of the pedal assembly 100. For clarity of illustration, the pedal assembly 100 is illustrated in FIGS. 8-11 with the foot member 104 pivoted upwardly away from the selector plate 116, which position would occur during the adjustment phase, and specifically just prior to the foot member 104 being lowered toward the selector platform 116 in a particular user-selected load setting. Each of FIGS. 8-11 show the selector platform 116 in a one of the plurality of predetermined selectable load setting positions. Each of the plurality of predetermined positions corresponds to a load setting. In the illustrated embodiment, four load settings (e.g., settings 0-3 as best seen in FIGS. 2 and 3) are available and each provides a different level of damping. In the first setting (e.g., setting 0) as shown in FIG. 8, which corresponds to the disengaged position, no damping is provided. In the second setting (e.g., setting 1) as shown in FIG. 9, which corresponds to a first engaged position, a low level of damping is provided by a low stiffness spring, for example spring 113-1. In this regard, spring 113-1 may also be referred to as a light spring. In the third setting (e.g., setting 2) as shown in FIG. 10, which corresponds to a second engaged position, a medium level of damping is provided by a single high stiffness spring, for example spring 113-2. In this regard, spring 113-2 may also be referred to as a heavy spring. In the fourth setting (e.g., setting 3) as shown in FIG. 11, which corresponds to a third engaged position, a high level of damping is provided by the combined stiffness of both light springs 113-1 and heavy spring 113-2. The terms low stiffness and high stiffness indicate a relative stiffness of the springs. That is, the low stiffness spring has a stiffness which is lower than the high stiffness spring, without limiting the springs to having a specific stiffness. Any number of springs and/or settings may be employed to achieve any desired number of levels of damping. Of course, other resilient members additionally or alternatively to springs may be used in other examples. Also, the reference numerals 0-3 for each setting may be different in other examples; the reference numerals 0-3 in this example are used for illustration only, e.g., to indicate the increasing level of resistance provided at the respective setting. Other alphanumeric characters or indications may be used to indicate the selectable load settings.

Referring back to FIG. 4, to move the selector platform 116 to one of the predetermined positions, the foot member 104 and selector platform 116 are pivoted about the axis 117, for example by the application of user force via the actuator 120. In selecting a particular load setting, the selector platform 116 and foot member 104 are raised (in the direction 109) to sufficiently remove the springs 113-1, 113-2 and post 150 from their respective seats so that the selector platform 116 can be pivoted to another position. After the selector platform 116 is pivoted to a desired position it is lowered into engagement at the selected position. In some examples, a detent 131 may be provided at each setting to actually guide the user's movement of the selector platform 116 to a predetermined position.

In FIG. 8, the selector platform 116 has been pivoted to the disengaged position. As the foot member 104 is lowered, the post 150 is received in a seat, e.g., a registration aperture 134-1 defined by the selector platform 116, positioning the selector platform 116 into an orientation in which the springs 113-1, 113-2 do not contact the selector platform 116. In this position, the post 150 may register against a surface of the selector platform 116 or, in the case of a through-hole aperture, against a surface of the bracket 142 to define the neutral position of the foot member 104. One or more shaped cavities may be defined by the selector platform 116 to provide the necessary clearance for the springs 113-1, 113-2. In some examples, the selector platform 116 may be shaped such that one or more of the springs 113-1, 113-2 remain outside the perimeter of the selector platform 116 when the selector platform 116 is in the disengaged position. In this illustrated example, the first spring is received in a first shaped cavity 136-1 and the second spring is outside of the perimeter of the selector platform 116. The first registration aperture 134-1 and the first shaped cavity 136-1 are associated with a first sector 192-1 which corresponds to the disengaged position. In the disengaged position, the springs 113-1, 113-2 do not contact the engagement side 162 and thereby the springs 113-1, 113-2 do not support the foot member 104. Instead, the foot member 104 is supported by the foot link 102 and laterally and longitudinally maintained in this position by the post 150. The post 150 may also provide support to the foot member 104. The foot member 104 may remain generally parallel with the foot link 102 during use, e.g., during a full stroke of the pedal assembly. During use in this selected position, the foot member generally does not pivot about its pivot axis 103.

To select an engaged position, the selector mechanism 114 is moved laterally, e.g., in a plane generally parallel to the foot member 104, from the disengaged position to a first engaged position. FIG. 9 illustrates the selector platform 116 pivoted to the first engaged position. In this position, the first spring 113-1 is aligned with a seat 166-1. As the foot member 104 is lowered into engagement with the engagement side 162, the end of first spring engages the seat 166-1. Lateral movement between the first spring 113-1 and the selector platform 116 is resisted by the seat 166-1. The seat 166-1 may be defined by a feature (e.g., protrusion) shaped to receive the end of the spring and prevent the end of the first spring 113-1 from slipping out of engagement with the engagement side 162. The seat 166-1 may be defined by a circular protrusion 167-1, which is sized to fit into the end of the coil of the spring 113-1, the protrusion having a diameter and/or length that does not interfere with the disengagement of the spring 113-1 from the protrusion. In other examples, the protrusion may be an annular protrusion sized to surround the end of the coil of the spring. In some examples, the selector platform 116 may be formed of a resilient material, such as high durometer rubber. In some examples, at least a portion of the selector platform, for example a portion extending to the engagement side 162, may be formed of a resilient material. A selector platform having a resilient material at the engagement side 162 may increase the friction between the contact side 162 and the respective ends of the springs 113-1, 113-2 and further aid in reducing relative lateral movement between the springs 113-1, 113-2 and the selector platform 116. In this position, the post 150 is aligned with another seat, e.g., a second registration hole 134-2, and the second spring 131-2 is aligned with a seat defined by the shaped cavity 136-2. The seats defined by the protrusion 167-1, the shaped cavity 136-2 and the second registration hole 134-2 are associated with a second sector 192-2 which corresponds to the first engaged position.

In this position, as shown in FIG. 9, initially, before the user steps on the pedal, the pedal may be displaced upwardly from the foot link 102 at an angle defined by the length of the spring (uncompressed, or partially compressed due to the weight of the pedal), defining a top position of the pedal. When the foot member 104 is weighted down by the weight of the user, the first spring 113-1 is fully or at least partially compressed. The pedal may return to a bottom position, in which the pedal is at a generally 0 degree orientation relative to the foot link 102. During use of the machine (e.g., during a pedal stroke), the pedal pivots repeatedly through a reciprocal motion, pivoting about the pivot axis 103 near the front of the pedal from the top position to the bottom position and back. In a typical forward mounted position by the user, the user's heels move furthest and the toes move less. In a reverse-mounted position by the user, the user's toes, which would be placed where the user's heels are typically placed and vice versa, would move more than the user's heels. During this reciprocal pivoting motion, the first spring 113-1 may, based on the load applied by the user, compress further or relax to its uncompressed or partially uncompressed state, and the post 150 moves freely in and out of the registration hole 134-1 and the second spring may move freely shaped cavity 136-1, respectively, such that the foot member 104 remains supported by the first spring 113-1 in this position. During a pedal stroke, the pedal may pivot between the bottom position when loaded (i.e., a 0 degree orientation relative to the foot link) and at least part of the way to the top position (e.g., a 45 degree orientation relative to the foot link). As described the top angled position may be defined by the length of the spring when unloaded, which position may be achieved if the pedal is fully unloaded. The dynamic resistance provided by a resilient member 112 may provide better support of the user's foot. In other words, by providing pressure against the heel end of the pedal 101 via the resilient member 112, the pedal may better support the user's heels during a greater portion of the stroke, particularly during portions in which the user's heel may naturally tend to lift off the pedal. This dynamic resistance may enable shifting the user's weight forward or otherwise advantageously improving the user's form and/or experience. Any number of resilient members 112 may be used to provide different amount of resilience, for example for accommodating users of different weights.

To select the next engaged position, the selector mechanism 114 is again moved laterally, e.g., in a plane generally parallel to the foot member 104. In FIG. 10, the selector platform 116 has been pivoted to the second engaged position. In this position, the second spring 113-2 is aligned with a seat 166-2. As the foot member 104 is lowered into engagement with the engagement side 162, the end of the second spring 113-2 engages the seat 166-2. Lateral movement between the second spring 113-2 and the selector platform 116 is resisted by the seat 166-2. The seat 166-2 may be defined by one or more irregularly shaped protrusions. For example, the seat 166-2 may have a generally circular shape defined by convex wall portions of the protrusion 168-1. The protrusion 168-1 may be shaped such that at least a portion of a wall defining the protrusion is received in the end of the spring 113-2 to prevent the spring 113-2 from slipping out of engagement with the engagement side 162. The portion of the wall of protrusion 168-1 that engages the end of spring 113-2 may abut the engaged end of the spring 113-2. The protrusion 168-1 may have a dimension selected such that the protrusion does not interfere with the disengagement of the spring 113-2 from the protrusion 168-1. The protrusion 168-1 may include one or more concave walls which may be shaped to provide clearance for spring 113-2 when spring 113-2 engages an adjacent seat, as will be described further with reference to FIG. 11.

The post 150 is aligned with another seat, a third registration hole 134-3, and the first spring 113-1 is aligned with another shaped cavity 136-3 defined by the selector platform 116. The shaped cavity 136-3 may be a generally circular hole sized for a clearance fit with the spring 113-1. The seats defined by the protrusion 168-1, the shaped cavity 136-3, and the third registration hole 134-3 are associated with a third sector 192-3 which corresponds to the second engaged position. As the foot member 104 is weighed down by the weight of a user, the second spring 113-2 is fully or at least partially compressed. During use of the machine, the second spring 113-2 may compress further or relax to its uncompressed or partially uncompressed state, and the post 150 and first spring 113-1 can move freely in and out of the registration hole 134-3 and shaped cavity 136-2, respectively, such that the foot member 104 remains supported by the second spring 113-2 in this position. In this position, a greater level of resistance as compared to the first engaged position may be provided by virtue of the heavy spring 113-2.

To select the next engaged position, the selector mechanism 114 is again moved laterally, e.g., in a plane generally parallel to the foot member 104. In FIG. 11, the selector platform 116 has been pivoted to the third engaged position. In this position, both the first and second springs 113-1, 113-2 are aligned with a respective seat 166-3, and 166-4, which resist lateral movement between the selector platform 116 and the first and second springs 113-1, 113-2, respectively. Lateral movement between the first spring 113-1 and the selector platform 116 may be resisted by the seat 166-3 and lateral movement between the second spring 113-2 and the selector platform 116 may be resisted by the seat 166-4, in this position. The seats 166-3, 166-4 may thereby advantageously prevent the springs 113-1, 113-2 from coming out of engagement with the engagement side 164.

Seat 166-3 may be defined by a protrusion 167-2 shaped and sized to fit inside an end of the coil of spring 113-1. For example, the protrusion 167-2 may be a generally circular protrusion with a diameter selected for a clearance fit with the spring 113-1. In other examples, the seat 166-3 may be defined by an annular protrusion which surrounds an end of the coil of the spring 113-1. The seat 166-4 may be defined by an irregularly shaped protrusion 168-2. The irregularly shaped protrusion 168-2 may be semi-circular or sickle shaped and may include a concave wall portion and a convex wall portion. The seat may be defined by the convex wall portion of protrusion 168-2. The concave wall portion may provide clearance for spring 113-2 when the spring 113-2 engages an adjacent seat (e.g., seat 166-2).

The post 150 is aligned with yet another seat in the form of a fourth registration hole 134-4. The seats defined by the protrusion 167-2, 168-2, and the registration hole 134-4 are associated with a fourth sector 192-4 which corresponds to the third engaged position. During use, the springs may compress and relax under user weight, and the post 150 may move freely in and out of the registration hole such that the foot member remains supported by both springs. In this position, a greater level of resistance as compared to the second engaged position may be obtained by virtue of using the light and heavy springs in combination.

Figure 12:
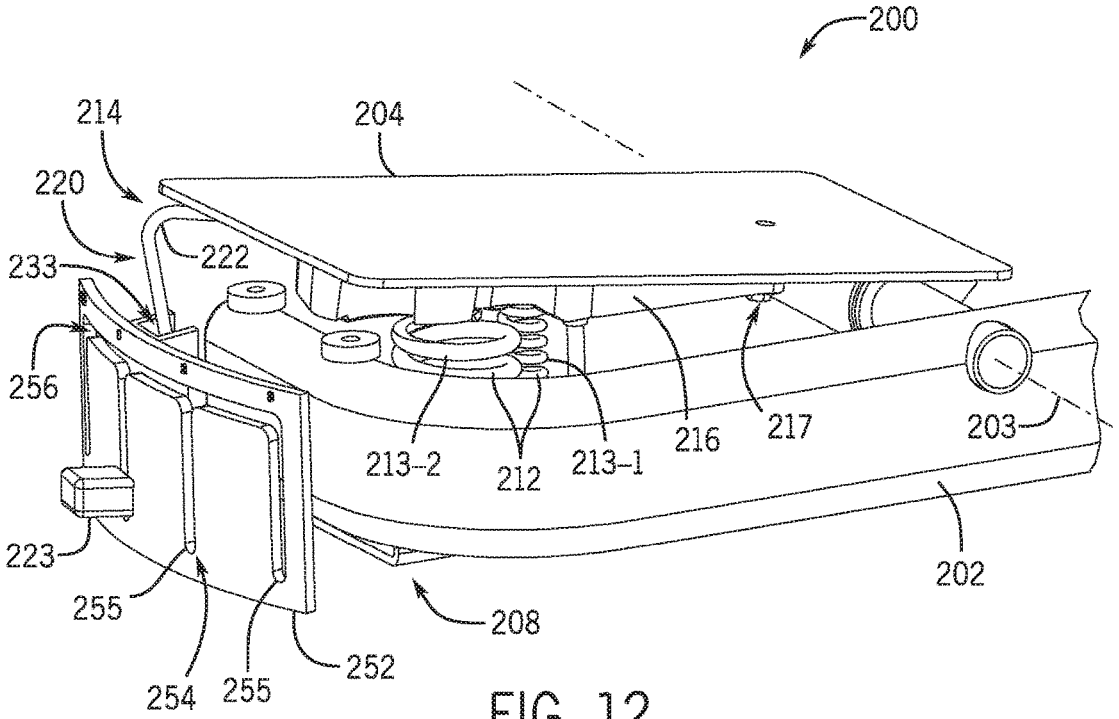
FIGS. 12, 13A and 13B are views of a pedal assembly according to a second embodiment.

FIG. 12 illustrates a partial isometric view of a pedal assembly 200 according to another embodiment. The pedal assembly 200 may include one or more of the components of the first pedal assembly 100, and in particular the adjustable damping assembly is the same as that shown in FIGS. 2-11, but with a different actuator as described below. Similar components and structure will be indicated using similar numbers and for brevity the description of these components will not be repeated. The pedal assembly 200 includes a foot member 204 (e.g., a plate or plate-like member), which is pivotally coupled to a foot link 202. The foot member is pivotable about pivot axis 203, which is perpendicular to the foot link 202. The pedal assembly 200 includes one or more resilient members 212 provided between the foot member 204 and the foot link 202. The resilient members 212 in this embodiment are in the form of helical compression springs 213-1, 213-2. The springs 213-1, 213-2 are supported on a support structure 208 connected to or integral with the foot link 202.

The pedal assembly 200 includes a selector mechanism 214 for adjusting a resilience (or damping level) of the pivotable foot member 204. The terms resilience and damping may be interchangeably used as these terms are related in that damping, which implies resistance to downward motion, and resilience, which implies upward force applied by a resilient member, may be viewed as equal and opposite actions that depend on the properties of the resilient member. As described herein, a plurality of selectable load settings may be provided, each load setting corresponding to a particular level of damping or resilience, e.g., based on the combination and arrangement of resilient members engaged.

The selector mechanism 214 may include a selector platform 216 pivotally connected to the foot member 204 via pivot joint 217. An actuator 220 extends rearwardly from the selector platform 216. The actuator 220 includes a rod 222. One end of the rod 222 is connected to the selector platform 216. The other end of the rod 222 is coupled to a knob 223 which engages a guide plate 252. The rod 222 is slidably received in a channel 233 of the knob 223. The channel includes an open end which receives the rod 222 and a closed end defined by a stop. The rod 222 engages the stop at the bottom end of the channel 233. The rod 222 moves freely within the channel 233. That is, the rod 222 may move up and down, for example due to pivoting action of the foot member 204, independently of the channel 233 and knob 223. The guide plate 252 includes a slot 254 and the knob 223 passes through the slot 254. An interface portion of the knob 223 is proximate an outward side of the guide plate 252 and the channel 233 of the knob 223 is on the opposite inward side of the guide plate 252.

The rod 222 in this embodiment is movably coupled to the knob 223. The rod 222 is slidably received in the channel 235. During adjustment, the foot member 204 is raised by lifting the actuator 220 in order for the selector platform 216 to clear the springs 213-1, 213-2 as the selector platform 216 is pivoted to another position. The lifting action causes the knob 223 to move in the slot 254 of the guide plate 252. Movement of the knob 223 is constrained both vertically and laterally by the slot 254. The slot 254 is shaped to guide actuator 220 to one of a plurality of predetermined settings, in this example four settings (0-3). The slot 254 is comb-shaped with each vertical slot 255 of the comb-shaped slot corresponding a setting. The lateral top slot 256 of the comb-shaped slot connects the vertical slots 255 to provide a path for moving the actuator 220 between and to particular settings.

Figure 13A:
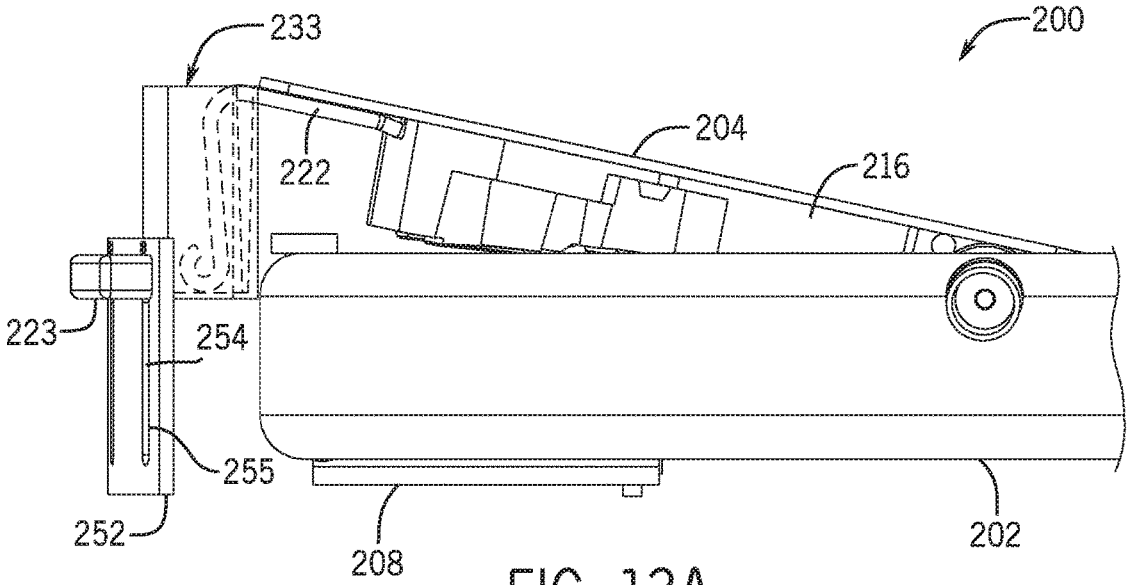
Figure 13B:
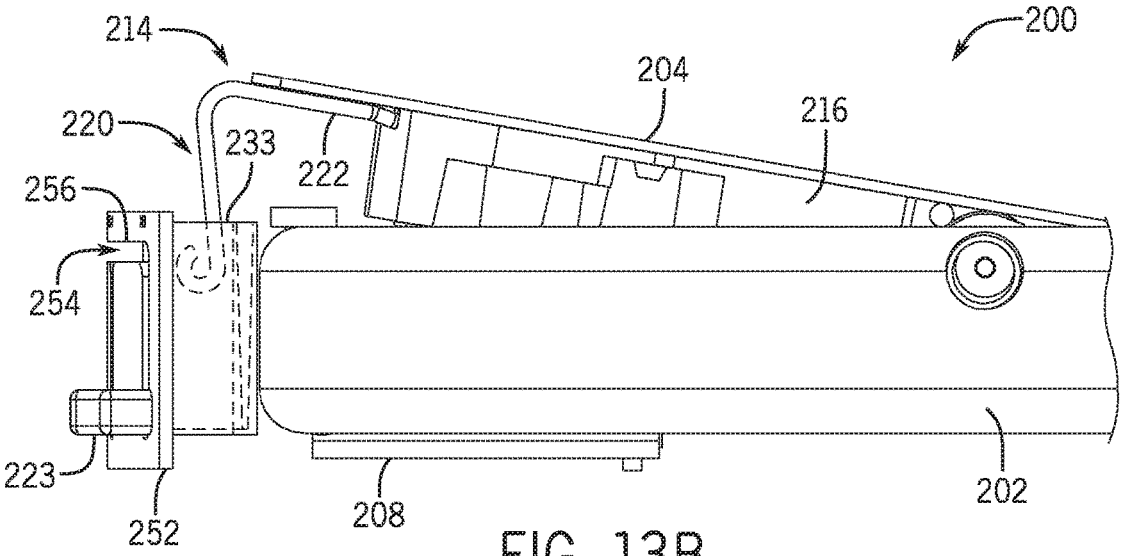
Figure 14B:
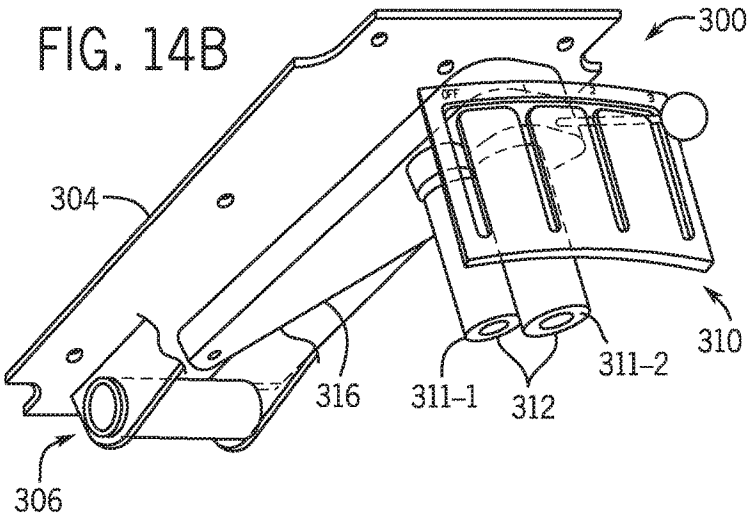
FIGS. 14A-D are views of a pedal assembly according to a third embodiment.
Figure 14D:
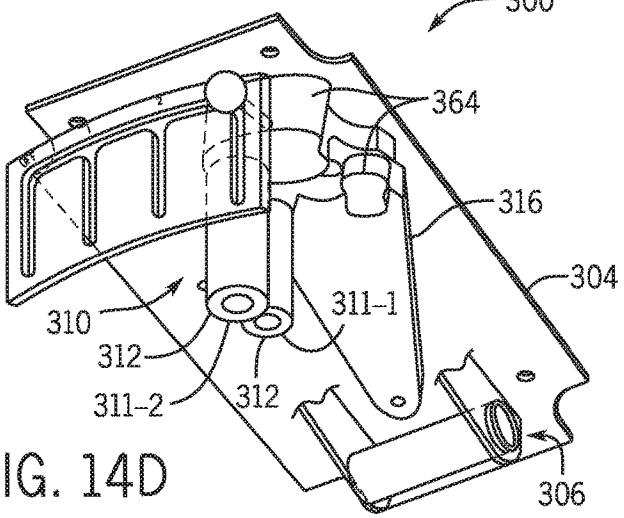
Figure 14A:
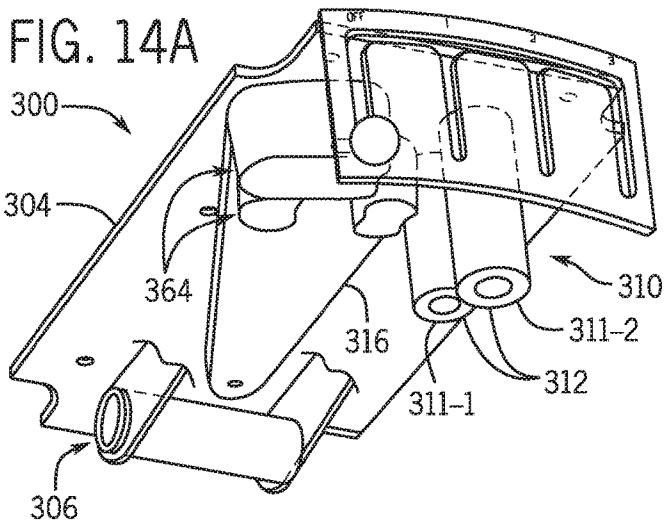
Figure 14C:
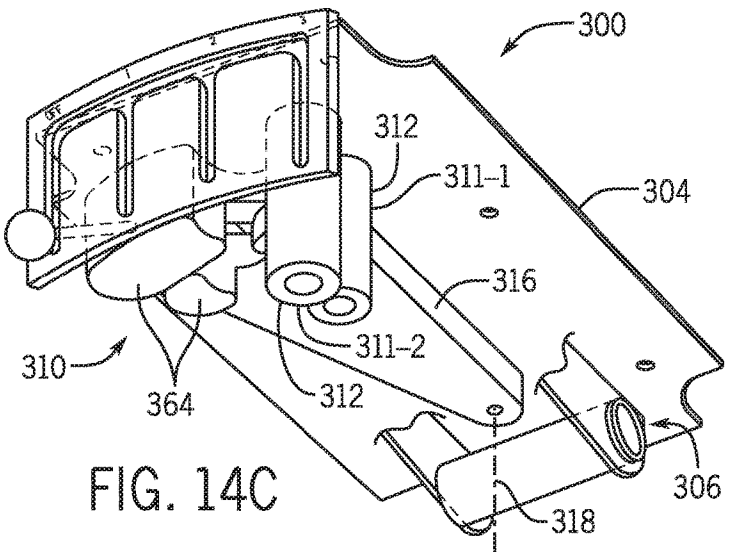

After the selector platform 216 has been laterally-pivoted to an engaged position, the foot member 204 remains in an angled position supported by an uncompressed or partially compressed spring (see FIG. 13A). The selector platform 216 and rod 222 remain at an angled position until the foot member 204 is weighed down by the user. While the foot member 204 and rod 222 remain angled upward, the knob 223 may return, by the force of gravity, to the bottom of the slot 233 by virtue of the slidable coupling between the rod 222 and knob 223. As the foot member 204 pivots down under user weight, the second end of the rod 222 slides within the channel 235 (see FIG. 13B). During use, as the foot member 204 may pivot up and down about the pivot axis 203 and the rod 222, which is rigidly connected to the selector platform 214 and foot member 204 may also pivot up and down with the foot member 204. The knob 223 may remain at the bottom of the slot 254 during use. To select another setting, the knob 223 may be grasped and raised towards the bridge 256 of the slot 254 until the knob 223 engages the rod 222 which can then be actuated via the knob 223.

FIGS. 14A-D are simplified isometric views of a pedal assembly according to another embodiment. The pedal assembly 300 may include one or more of the components of the previously described pedal assemblies 100 and 200, thus their description will not be repeated. For example, the pedal assembly 300 includes a foot member 304 configured to be pivotally coupled to a foot link via a pivot joint 306. The pedal assembly 300 includes an adjustable damping assembly 310, which may include a selector platform 316 and at least one resilient member 312. Ends of the resilient members may engage the selector platform 316 and thereby support the foot member 604 when the selector platform 316 is moved laterally to one or more engaged positions. In the illustrated example, the selector platform 316 is pivotally coupled to the foot member 304 such that the selector platform 316 can pivot in plane about the pivot axis 318. The selector platform 316 includes one or more engagement features 364 configured to engage the one or more resilient members 312 for providing a selectable damping of the foot member. In this illustrated embodiment, the one or more resilient members 312 are implemented in the form of elongated members 311, in one example having a tubular shape and being made from a single piece of resilient material. A first elongated member 311-1 may have a first stiffness and a second elongated member 311-2 may have a second stiffness greater than the first stiffness. The stiffness of the tubular members 311 may be tailored by varying a radius and/or thickness and/or durometer of the tubular members 311. In some examples, different resilient materials may be used for the different tubular members to obtain different stiffnesses. Resilient members with hollow central portions may provide greater flexibility for tailoring the stiffness of the resilient members. However, resilient members in the form of solid elongate members, such as solid cylindrical members, are also envisioned and may be used in some embodiments. The resilient members may have various cross-sectional shapes, such as circular, oval, square, rectangular, or irregular shapes.

FIGS. 15A-15D illustrate simplified views of an adjustable pedal assembly 400 according to another embodiment. The adjustable pedal assembly 400 includes a pivotable foot member 404, which may take the form of a plate or plate-like structure. The foot member 404 is configured to be pivotably coupled to a foot link via a pivot joint 406, in a manner similar to or the same as that of the first embodiment shown in FIG. 2. The pedal assembly 400 includes at least one resilient member 412 positioned between the foot member 404 and foot link In this illustrated embodiment, the pedal assembly 400 includes three resilient members 412. The resilient members 412 are implemented in the form of generally rounded bodies 415-1, 415-2, and 415-3 made from a resilient material, such as rubber. The rounded bodies 415-1, 415-2, and 415-3 may be generally spherical in some examples and may define hollow interior portions. Each of the rounded bodies 415-1, 415-2, and 415-3 may have a different stiffness to provide a different level of damping, the stiffness differences being based on material type, overall dimension if the body is solid, or wall thickness where the body is hollow.

The pedal assembly 400 may include a selector mechanism 410 movable in a plane at least between an engaged position in which the foot member 404 is supported by at least one resilient member 412 and a disengaged position in which the foot member 404 is not supported by any resilient members 412. The selector mechanism 410 in this embodiment is implemented in the form of a plate 437 supporting the rounded bodies 415-1, 415-2, and 415-3. The plate may interchangeably be referred to as carrier. The plate may be generally circular in some examples, and may in such examples also be referred to as a disc. The plate 437 may be rotatably coupled to the foot link abut rotational centerline 419. For example, the plate 437 may be operatively coupled to the foot link by conventional rotatable couplings such as bearings or gears. The rounded bodies 415-1, 415-2, and 415-3 are arranged in a radial, for example circumferential, pattern around the rotational centerline 419 of the plate 437. Thus, radial sectors around the plate's circumference may be associated with one or more selectable load settings. The plate 437 is rotatable about its centerline to a plurality of engaged positions, in each of which the foot member 404 is supported by a rounded body (see FIGS. 15B-D). The plate 437 is also rotatable to a disengaged position in which the foot member 404 is not supported by a rounded body (see FIG. 15A). In this manner, the pivotable foot member 404 may be selectively positioned in contact with none or one of the spherical bodies 415-1, 415-2, and 415-3 to achieve a different level of damping as may be desired.

A follower 439 may extend downwardly from the foot member 404, and in one example may be provided on a bottom surface of the foot member 404. The follower 439 may include a body portion configured to engage and move relative to the resilient rounded bodies 415. For instance, the body of the follower may have rounded sidewalls, or may have a generally semi-spherical shape. A base of the follower 439 is attached to the foot member 404. When in a selected orientation to engage a resilient body, a top surface 497 of the follower 439 engages a respective top surface 498 of one of the rounded bodies 415-1, 415-2, and 415-3 or none of the spherical bodies depending on the selected position. A plurality of posts 441 may extend perpendicularly from the disc 437 towards the foot member 404. The posts 441 may be arranged between adjacent spherical bodies to provide transition surfaces as the follower 439 moves from contact with one spherical body to an adjacent spherical body. In some examples, the carrier may not include posts. In some examples, adjacent spherical bodies may be closer together than the illustrated examples. In such examples, a transition surface, as provided by the posts, may not be included. A pair of ramps 445-1, 445-2 may be attached to the disc 437. An ascending ramp 445-1 may guide the follower 437 in an ascending path from the disengaged position towards a first engaged position. A descending ramp 445-2 may guide the follower 437 from the last engaged position (in this case a third engaged position) to the disengaged position. Any number of resilient members, greater or fewer than illustrated, may be used.

Figure 15C:
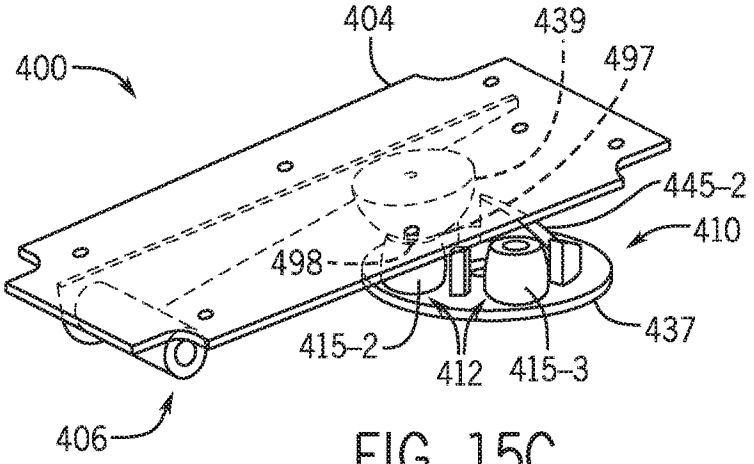
FIGS. 15A-D are views of a pedal assembly according to a fourth embodiment.
Figure 15D:
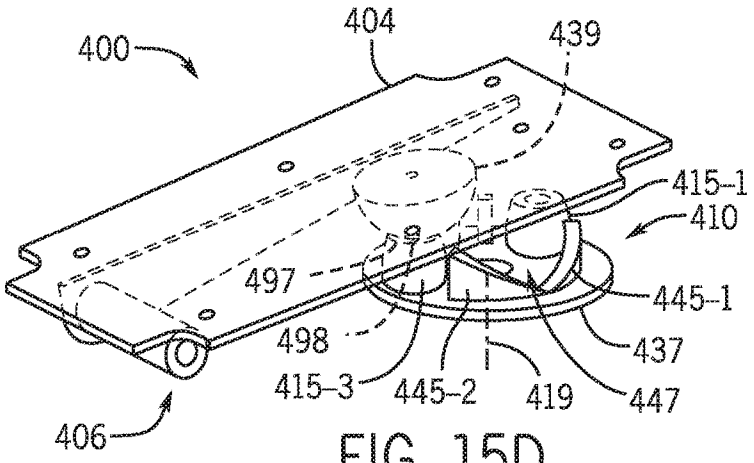
Figure 15A:
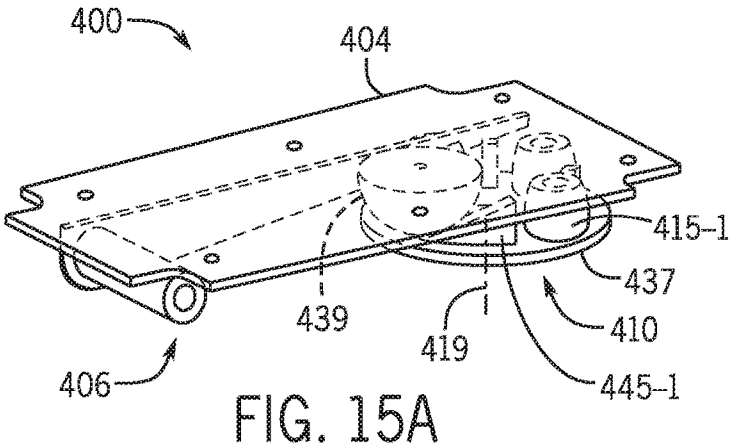
Figure 15B:
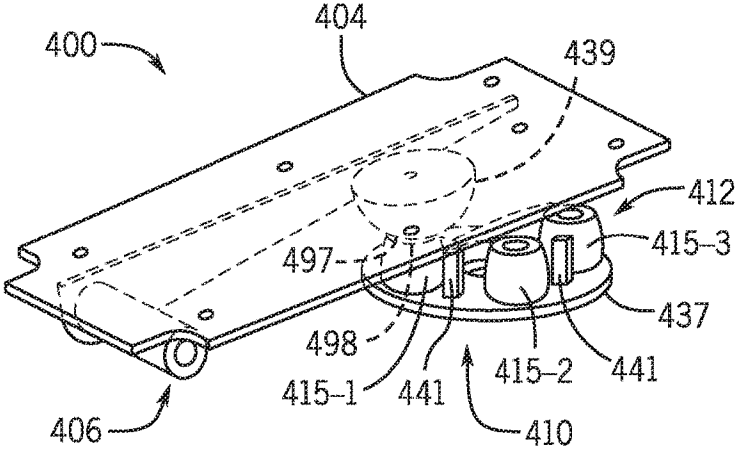

FIG. 15A shows the pedal assembly 400 in the disengaged position, in which the follower 437 is seated between the pair of ramps 445-1 and 445-2. As the disc 437 is rotated from the disengaged position to the first engaged position, the follower 437 moves along the ascending ramp 445-1 until it engages the first spherical body 415-1, as shown in FIG. 15B. As the disc 437 is rotated from the first engaged position to a second engaged position, the follower 439 passes over a first post 441 positioned between the first and second spherical bodies 415-1 and 415-2, respectively, until the follower 439 engages the second spherical body 415-2, as shown in FIG. 15C. As the disc 437 is rotated from the second engaged position to a third engaged position, the follower 439 passes over a second post 441 positioned between the second and third spherical bodies 415-2 and 415-3, respectively, until the follower 439 engages the third spherical body 415-3. As the disc 437 is further rotated from the third engaged position to the disengaged position, the follower 439 descends along the descending ramp 445-2 to a seat 447 defined by the two ramps.

Figure 16:
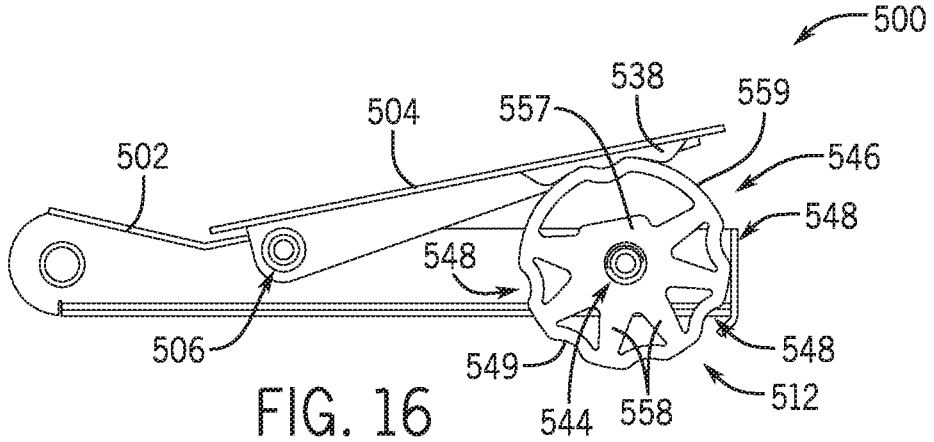
FIG. 16 is a simplified side view of a pedal assembly according to a fifth embodiment.
Figure 17:
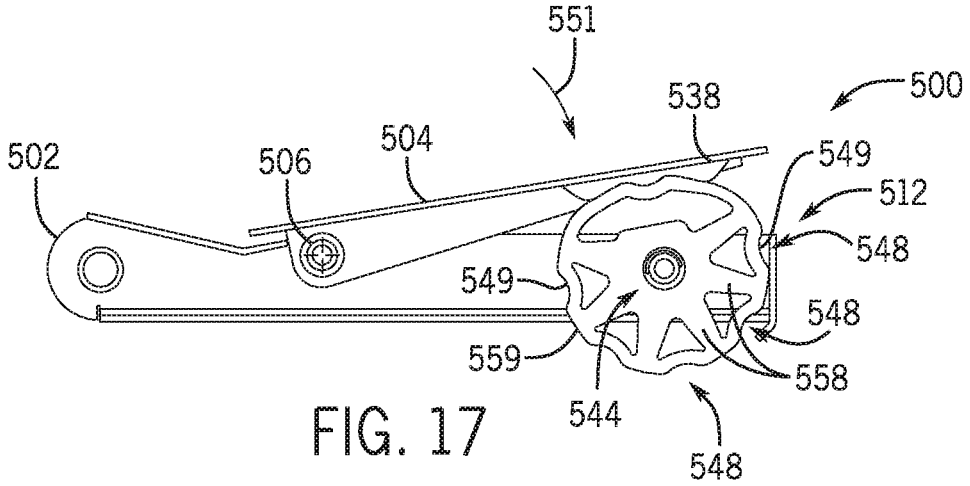
FIG. 17 is a simplified side view of the pedal assembly in FIG. 16, with the resilient member shown in a deflected state.

FIGS. 16 and 17 illustrate simplified side views of an adjustable pedal assembly 500 according to another embodiment. The pedal assembly 500 may include a foot member 504 pivotally coupled to a foot link 502 via a pivot joint 506. In this embodiment, the pivotable foot member 504 is supported by at least one resilient member 512, which is rotatable to adjust the level of damping. The resilient member 512 may be provided adjacent one side of the foot member or at an intermediate location between the sides of the foot member. The resilient member 512 is attached to the foot link 502 via the pivotal joint 544. A follower 538 is attached to the foot member 504 and configured to contact the resilient member 512. The resilient member includes a plurality of sectors 548, each sector defining a different level of stiffness. The resilient member 512 in this illustrated example is implemented in the form of a wheel 546 with a plurality of spokes 558. The thickness, width, shape, and spacing of the spokes 558 may vary. A stiffness of a given sector of the resilient member may be tailored by varying a parameter associated with a spoke, such as a thickness, a width, a shape, or a spacing of adjacent spokes. A peripheral ring 559 connects the radial end portions of the spokes 558. The peripheral ring 559 may include an engagement feature to provide a tactile feedback of a selected engagement position to the user. The engagement feature of the peripheral ring 559 may be a detent or plurality of detents 549 which engage with corresponding features on the follower 538 to enhance the tactile feedback of a selected position.

FIG. 16 shows the pedal assembly in a first position in which the resilient member 512 provides no damping or a low level of damping. Initially, before the foot member 504 is weighed down by the user, the weight of the pedal may be supported in an angled position by the resilient member 512. This angled position, may also be referred to as upper position. When the foot member 504 is pivoted down, e.g., by user weight, as indicated by arrow 551, the resilient member 512 deforms (see FIG. 16). In the first position, the resilient member 512 may be configured to deform until the foot member 504 is in a generally 0 degree orientation when the user steps on the pedal. The position of the pedal in this 0 degree orientation may also be referred to as a bottom position. The resistance provided by the resilient member at this first position may be minimal and the peripheral ring 559 may contact the hub 557. The wheel-shaped resilient member 512 may be rotated to a plurality of additional positions, in this case five additional positions. These positions may be referred to as the engaged positions. The resilient member 512 may be configured to provide an increasing level of resistance at each subsequent of these positions as the wheel is turned counter clockwise, for example, as shown in FIGS. 16 and 17. During use, the pedal may pivot from the upper position and one or more intermediate lower positions between the upper position and bottom position when the wheel is provided in an engaged position.

Figure 18:
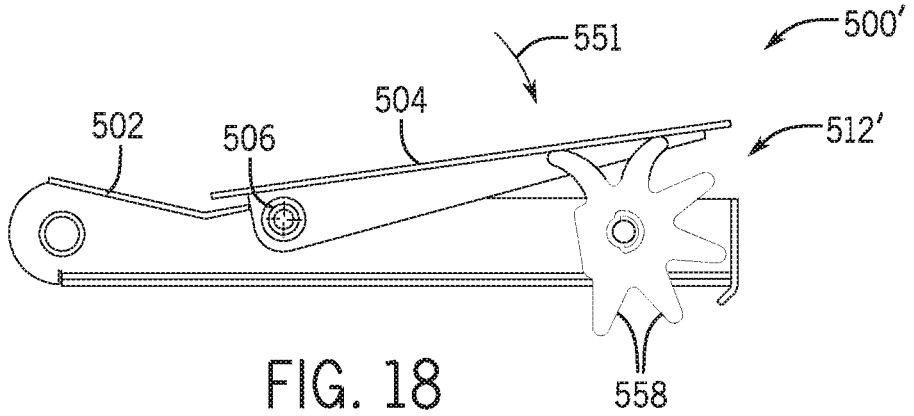
FIG. 18 is a simplified side view of a pedal assembly according to a sixth embodiment.

FIG. 18 illustrates a simplified side view of an adjustable pedal assembly according to another embodiment. The pedal assembly 500' in this embodiment is substantially similar as the pedal assembly 500 in FIGS. 16 and 167 with a modified resilient member 512', which does not include a peripheral ring 559 as shown in FIG. 16. The spokes 558 may be similarly configured to provide sectors with variable resistance in a manner similar to the one described above. When provided in an engaged position, the foot member 504 may engage a top portion of one or more adjacent spokes. In some examples, the foot plate engages top portions of two adjacent spokes. The spokes may resilient deflect or deform under user weight during use, e.g., as illustrated in FIG. 18.

Figure 19:
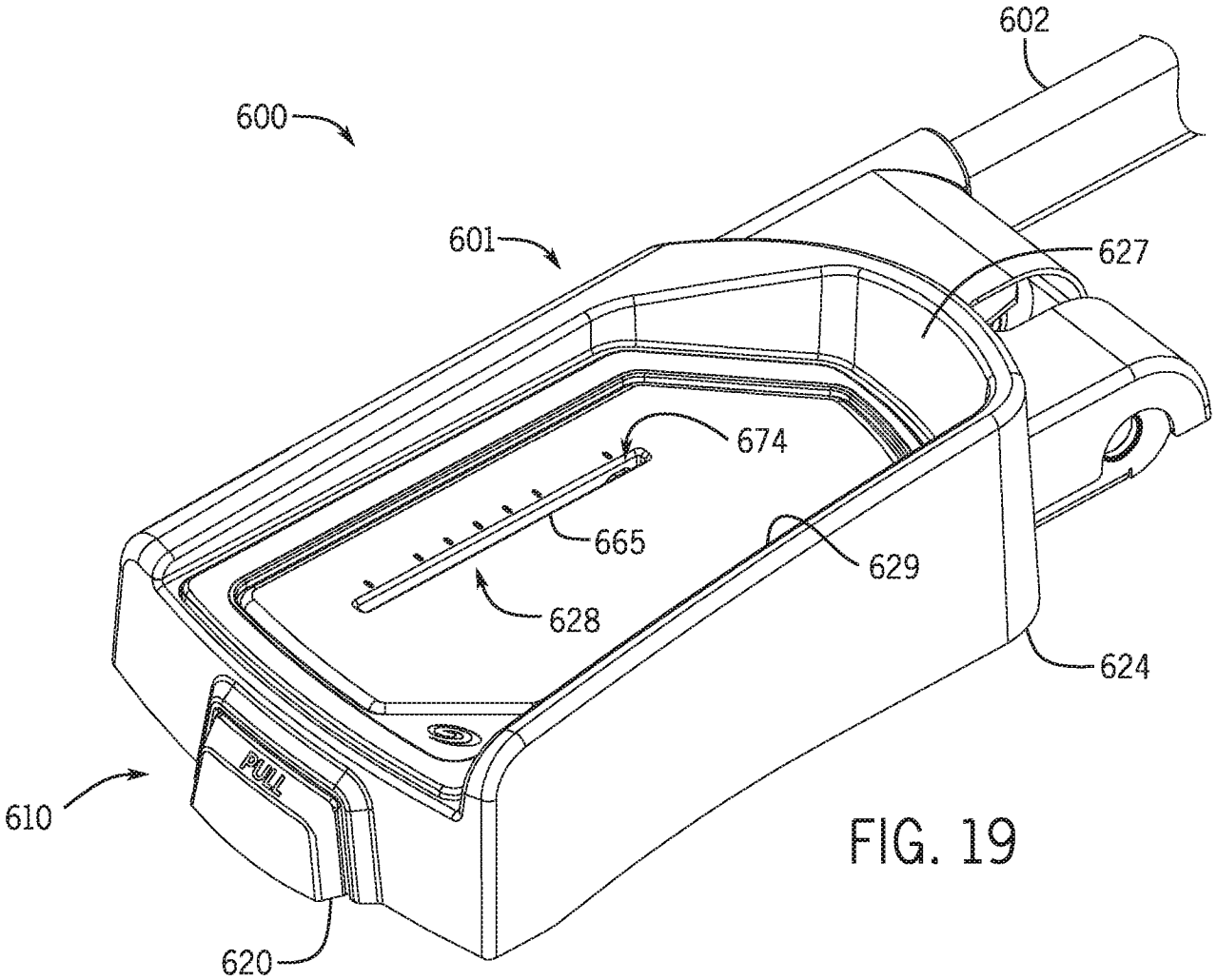
FIG. 19 is an isometric view of a pedal assembly according to a seventh embodiment.

FIGS. 19-21C illustrate views of an adjustable pedal assembly according to another embodiment. FIG. 19 shows an isometric view of an adjustable pedal assembly 600. The adjustable pedal assembly 600 may include a pedal 601, which is adjustable such that it can pivot during use when the pedal is provided in an engaged position. When in an engaged position, the pedal 601 may be resiliently supported by one or more resilient members. Thus, pivoting action of the pedal 601 may be damped by the one or more resilient member during use.

The pedal assembly 600 may include an adjustable damping assembly 610 for selecting a load setting. The adjustable damping assembly 610 may include a selector mechanism configured to move in a plane to select a desired load setting. The selector mechanism may be implemented in the form of a ratcheted shuttle engaging the resilient member such that a desired load setting may be selected as described further below.

The pedal 601 may be pivotably coupled to a foot link 602 via a pivot joint 606. In the illustrated example, the pedal 601 is pivotably coupled to the foot link 602 near a toe end of the pedal 601. In other examples, the pedal 601 may be pivotably coupled to the foot link 602 at another location, for example the heel end of the pedal 601.

The pedal 601 may include a foot member 624 that encloses one or more of the components of the pedal assembly 600 and an indicator 628 that may enable the user to attain and perceive the desired load setting. The foot member 624 may include a wall 627 provided in a forward portion of the pedal 601. The wall 627 may extend upwardly from a foot contact surface of the pedal 601. The wall 627 may be configured to prevent the user's foot from sliding forwardly off the pedal 601. The foot member 624 may, additionally or alternatively, include one or more sidewalls 629, which may restrain lateral movement of the user's foot.

Figure 20:
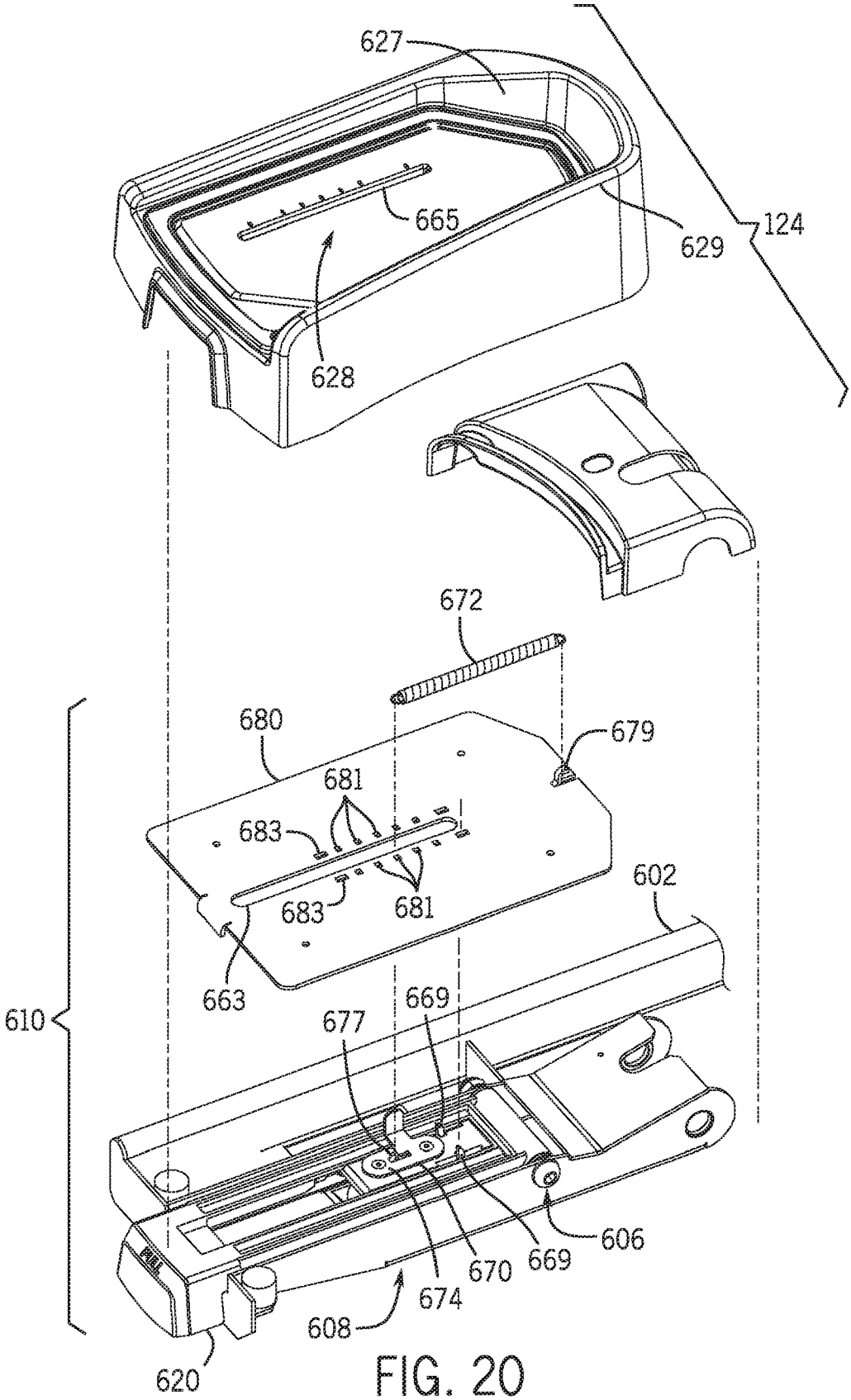
FIG. 20 is an exploded view of the pedal assembly in FIG. 19.
Figure 21A:
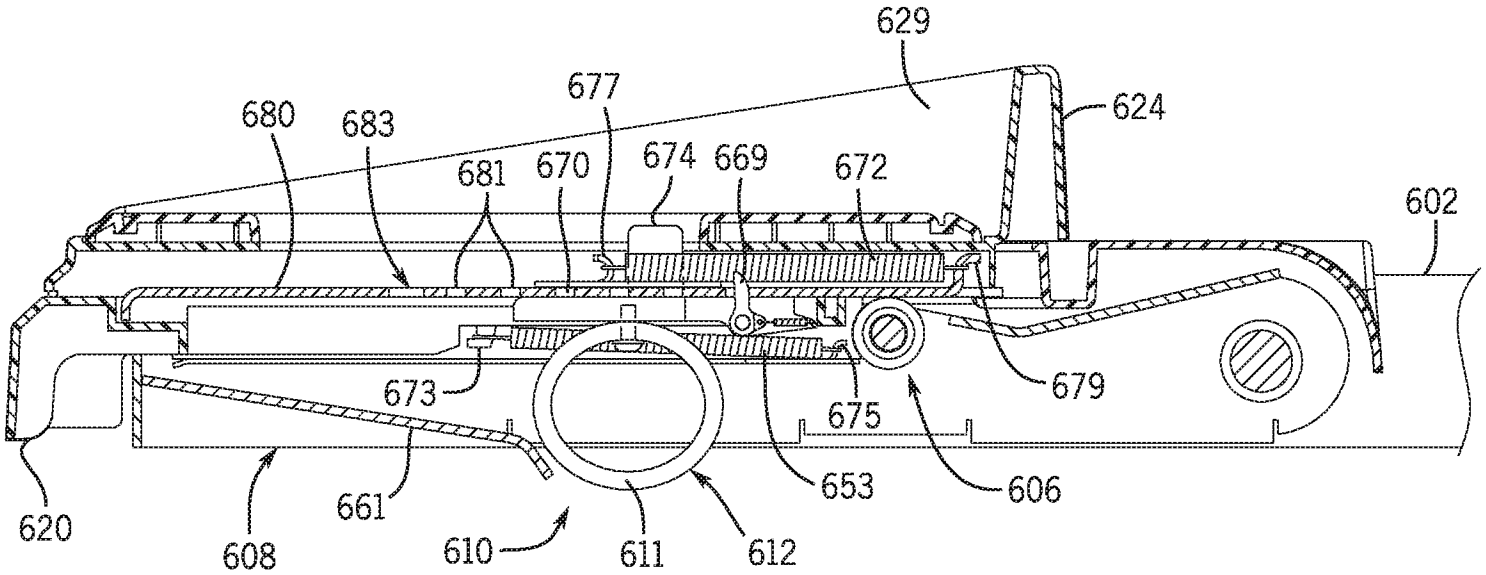
FIGS. 21A-21C are representational cross-sectional views of the pedal assembly in FIG. 19 in different positions, taken along line A-A of FIG. 19.
Figure 21B:
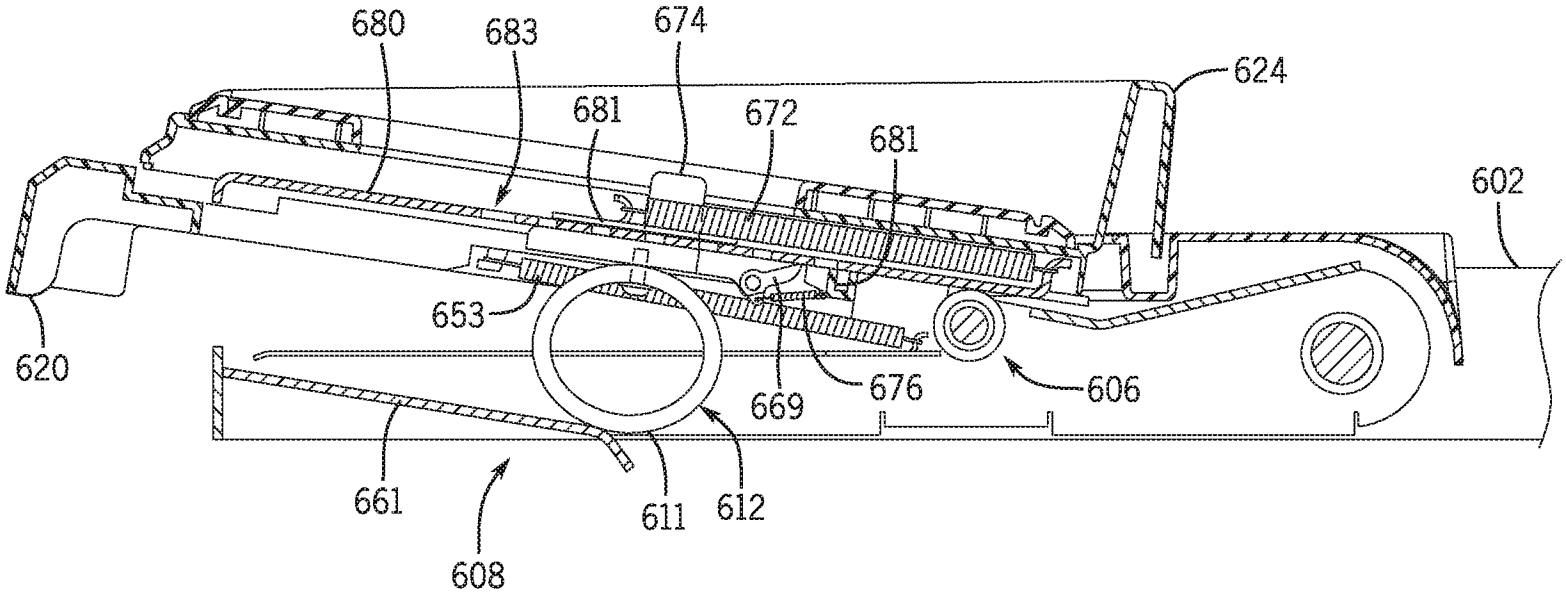
Figure 21C:
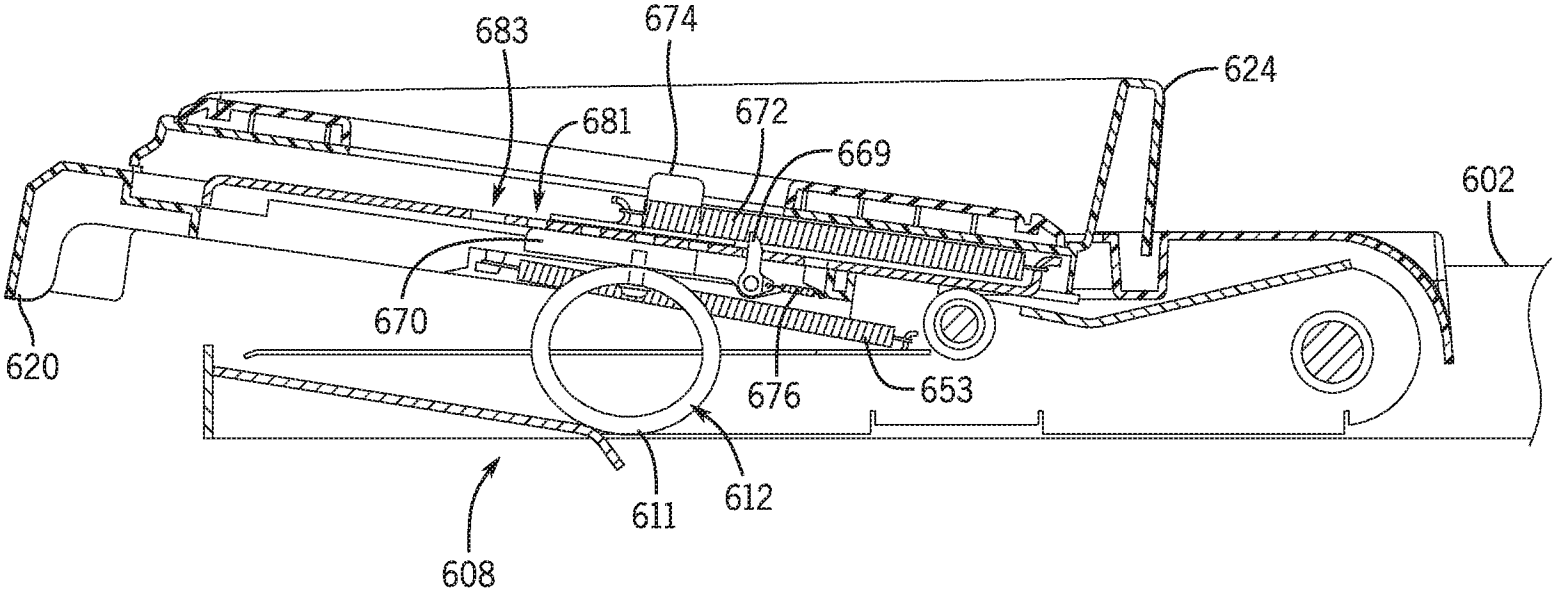

Referring now also to FIGS. 20-21C, the adjustable damping assembly 610 may include a shuttle 670 which engages a ratchet plate 680. The shuttle 670 is actuated via an actuator member 620. An aft portion of the actuator member 620 protrudes through an opening in the foot member 624 and extends aft to enable the user to grasp the actuator member 620. The shuttle 670 includes a shuttle body 671 configured to move forward and aft. The shuttle body 671 may move generally in a plane parallel to the pedal. An angled bracket 674 may be attached to the shuttle body 671. A slot 663 may be provided in the ratchet plate 680 and a slot 665 may be provided in the foot member 624. The slots 663 and 665 may be sufficiently aligned to allow the top portion of the angled bracket 671 to protrude through the slots 663 and 665. In this manner, the top portion of the angled bracket 671 may work in conjunction with markings on the foot member 624 to serve as the indicator 628. A forward portion of the actuator member 620 abuts a forward end of the shuttle 670 such that the shuttle is forced aft when the actuator member 620 is pulled aft.

The actuator member 620 is connected to the supporting structure 608 via an actuator spring 653, for example a tension spring. One end of the actuator spring 653 is connected to a hook 673 on the actuator member 620 and another end of the spring 653 is connected to a hook 675 on the supporting structure 608. The actuator spring 653 biases the actuator member 620 in a forward direction. The actuator spring 653 enables the actuator member 620 to return to a retracted position after selecting a load setting. The retracted position of the actuator member 620 may correspond to the forward most position of the actuator member 620. The shuttle 670 remains at a position corresponding to the selected setting, also referred to as engaged positions, by virtue of a ratchet mechanism, while the actuator member 620 returns to the retracted position.

The shuttle 670 is connected to the pedal 601 via a shuttle spring 672. One end of the shuttle spring 672 is connected to a hook 677 on the shuttle 670 and the other end of the shuttle spring 672 is connected to the ratchet plate 680, e.g., via the hook 679. The shuttle spring 672 biases the shuttle 670 in a forward direction to enable the shuttle 670 to return to a disengaged position. The disengaged position of the shuttle 670 may correspond with the forward most position of the shuttle 670. The shuttle 670 is retained in one or more aft positions corresponding to a selected setting, also referred to as engaged positions, by the ratcheting mechanism.

The ratchet mechanism includes a ratchet plate 680 which includes a plurality of ratchet holes 681 and one or more tines 669 which engage respective ones of the ratchet holes 681. In some examples, a single tine may be used with a corresponding set of ratchet holes 681. In some examples, a plurality of tines may be used for redundancy, e.g., to increase the reliability of the ratchet mechanism. The ratchet plate 680 also includes one or more release holes 683. The release holes 683 are sufficiently large to prevent the tines 669 from engaging the ratchet plate 680 when the shuttle 670 is moved to a location where the tines 669 align with the release holes 683.

The tines 669 are biased in an upward orientation by tine springs 676. In an engaged position, the tines 669 engage the ratchet plate 680 via respective ratchet holes 681, thus resisting movement of the shuttle 670. The shape of the tines and size of the ratchet holes 681 are selected to allow the tines 669 to deflect only clockwise when the tines 669 engage the ratchet holes 681. For example, a forward side of a top portion the tines 669 may be curved to allow the tine to rotate forward (clockwise in FIG. 21A) within a ratchet hole to exit the ratchet hole. When the shuttle 670 moves aft against the force of the shuttle spring 672, the tines 669 are temporarily deflected forward and downward in a clockwise direction as shown in FIG. 21B. An aft wall of the ratchet hole 681 within which a tine 669 extends engages an aft wall of the tine 669 causing the tine 669 to rotate forward (clockwise) and withdraw from the ratchet hole 681. As the tine 669 is moved aft towards the next ratchet hole 681, the top end of the tines 669 slides against the bottom surface of the ratchet plate 680 as the tines 669 pass under the ratchet plate 680 between ratchet holes 681. When the tine 669 is moved to a location of a next ratchet hole, the tines 669 spring back under the force of ratchet springs 676 to the upward position and engage the ratchet plate 680.

To release the ratchet and return the shuttle 670 to the disengaged position, the shuttle 670 is moved further aft beyond all of the engaged positions until the tines 669 reach the release holes 683. The size of the release holes 683 is sufficiently large to allow the tines 669 to also rotate in a counterclockwise direction within the release hole. That is, a dimension of the release hole 683 may be selected to be equal to or exceed a length of a top portion of the tine 669 which protrudes through the release hole 683. Thus, as a tine 669 rotates within a release hole 683, the top portion of the tine 669 sweeps an arc with a diameter which may be equal to or smaller than the size of the release hole 683, allowing the tine 669 to withdraw from the release hole 683. As the biasing force of the shuttle spring 672 pulls the shuttle 670 towards the forward end of the pedal, the tine 669 rotates counterclockwise within the release hole 683 against the biasing force of its tine spring 676 which pull the tine to an upward position, allowing the shuttle 670 to return to the disengaged position.

As best seen in FIGS. 21A-21C, the supporting structure 608 includes a ramp 661, which is configured to operatively engage the resilient member 612 when the resilient member 612 is moved to an engaged position. The resilient member 612 is configured to move aft and up the ramp to provide a desired level of resilience (or damping). The resilient member 612 in this illustrated embodiment is implemented in the form of a generally tubular member 611 made from a resilient material such as rubber. The tubular member 611 is arranged generally sideways, with an upper sidewall of the tubular member 611 attached to the shuttle and a lower sidewall engaging the ramp when the pedal is in an engaged position. An axial orientation of tubular member 611 may be generally parallel to the ratchet plate 680 and thus generally perpendicular to the foot link 602. Resilience by the resilient member 612 is provided as a result of the compression of the generally tubular resilient member along a diameter of the generally tubular resilient member. In some examples, the upper sidewall of the generally tubular resilient member may be fixedly attached to the shuttle 670, for example using a conventional fastener. Thus, the tubular member 611 may be configured to move with the shuttle 670 as the shuttle 670 moves forward and aft. Thus, movement of selector mechanism generally in a plane (e.g., between sectors corresponding to different load settings), moves the resilient member between the engaged positions.

In the disengaged position, the tubular member 611 may not contact the supporting structure 608. Thus, no resilience is provided by the tubular member 611 and foot member is at a neutral supported position, in which the foot member is supported by the underlying structure in a non-resilient manner In the disengaged position, the pedal 601 may be generally parallel with the foot link 602 (e.g., arranged at a 0 degree orientation relative to the foot link). As the shuttle 670 moves aft to an engaged position, the tubular member 611 travels up the ramp 661 increasing the angle between the pedal 601 and the foot link 602. The further aft the tubular member 611 is positioned, the greater the initial (e.g., unweighted) angle of the pedal 601 and thus the greater the resilience level. As the user steps on the pedal 101, the tubular member 611 may be deformed from a generally circular shape to a flattened (or generally oval) shape. As the pedal moves through a stroke, the amount of pressure at the heel end may vary due to the natural rolling motion of the user's foot. Thus, the pedal may pivot up from the neutral position under the spring force of the tubular member 611. This dynamic response of the pedal may enable increased contact of the user' s foot with the pedal through a greater portion of the stroke, which may improve the overall user experience.

Examples in accordance with inventive aspects of the present disclosure are further described in the below enumerated paragraphs:

A1. A pedal assembly for an exercise machine, the pedal assembly comprising: a foot link; a foot member pivotally connected to the foot link; at least one resilient member positioned between the foot member and the foot link; and a selector mechanism movable at least between a first position in which the foot member is supported by the at least one resilient member and a second position in which the foot member is not supported by the at least one resilient member.

A2. The pedal assembly according to paragraph A1, wherein the selector mechanism comprises a selector platform configured to move between the first position and the second position.

A3. The pedal assembly according to paragraph A2, wherein the selector platform is pivotally coupled to the foot member.

A4. The pedal assembly according to paragraph A2 or A3, wherein the selector platform is pivotable about a pivot axis perpendicular to the foot member.

A5. The pedal assembly according to any of paragraphs A2-A4, wherein the selector platform comprises a contact side positioned to at least partially contact the foot member during at least a portion of a stroke of the pedal assembly, and an engagement side in contact with the at least one resilient member when the selector platform is in the first position.

A6. The pedal assembly according to paragraph A5, wherein the engagement side is opposite the contact side.

A7. The pedal assembly according to paragraph A5, wherein the engagement side comprises one or more engagement features configured to resist relative movement between the selector platform and the at least one resilient member.

A8. The pedal assembly according to paragraph A7, wherein the at least one resilient member comprises a spring and wherein the one or more engagement features comprise a seat configured to engage the spring.

A9. The pedal assembly according to paragraph A7, wherein the at least one resilient member comprises two or more springs.

A10. The pedal assembly according to paragraph A9, wherein the two or more springs comprise a first spring and a second spring stiffer than the first spring.

A11. The pedal assembly according to paragraph A9 or A10, wherein the two or more springs comprise two or more helical compression springs.

A12. The pedal assembly according to any of paragraphs A1-A7, wherein the at least one resilient member comprises an elongate member formed of resilient material.

A13. The pedal assembly according to paragraph A9-A11, wherein the two or more springs comprise a first spring and a second spring, and wherein the one or more engagement features comprise a first seat to resist relative movement between the first spring and the selector platform when the selector platform is in the first position.

A14. The pedal assembly according to paragraph A13, wherein the selector platform is configured such that the foot member is not supported by the second spring when the selector platform is in the first position.

A15. The pedal assembly according to paragraph A13 or A14, wherein the one or more engagement features comprise a second seat configured to resist relative movement between the second spring and the selector platform when the selector mechanism is in a third position.

A16. The pedal assembly according to paragraph A10-A15, wherein the engagement side comprises a first region configured to engage only one spring of the two or more springs and a second region configured to engage only another one of the two or more springs.

A17. The pedal assembly according to paragraph A16, wherein the first region is located near a perimeter of the engagement side and the second region is adjacent to the first region.

A18. The pedal assembly according to any of paragraphs A2-A17, wherein the at least one resilient member comprises a first resilient member and a second resilient member and wherein the engagement side comprises an engagement sector including engagement features to resist relative movement between the selector platform and the first resilient member, the second resilient member, or both.

A19. The pedal assembly according to paragraph A18, wherein the first engagement sector correspond to the first position, the pedal assembly further comprising a second engagement sector corresponding to a third position in which the selector platform contacts the first resilient member, the second resilient member, or both.

A20. The pedal assembly according to any of paragraphs A9-A11 and A13-A15, wherein the springs are connected to a support structure below the foot member.

A21. The pedal assembly according to paragraph A20, wherein the springs are removably connected to the support structure.

A22. The pedal assembly according to paragraph A20 or A21, wherein the support structure includes a base comprising a plurality of holes sized for an interference fit with the springs.

A23. The pedal assembly according to any of paragraphs A20-A22, wherein the selector platform, the base, or both are made from a resilient material.

A24. The pedal assembly according to any of paragraphs A20-A23, wherein the base rests on a bracket attached to the foot link A25. The pedal assembly according to any of paragraphs A20-A24, further comprising a post positioned between the foot member and the support structure, wherein the foot member rests on the post when the selector platform is in the second position.

A26. The pedal assembly according to paragraph A25, wherein the selector platform comprises at least one registration hole configured to receive the post at least partially therein.

A27. The pedal assembly according to paragraph A25 or A26, wherein the selector platform is movable to a plurality of predetermined positions including the first and second positions, and wherein the selector platform further comprises a registration hole for each of the plurality of predetermined positions, the registration hole configured to receive, at least partially, therein the post.

A28. The pedal assembly according to any of paragraphs A25-A27, wherein the post comprises a resilient material at a free end of the post.

A29. The pedal assembly according to any of paragraphs A2-A28, further comprising an actuator connected to the selector platform.

A30. The pedal assembly according to paragraph A29, wherein the actuator comprises a knob and a rod, the knob movably coupled to the rod.

A31. The pedal assembly according to any of paragraphs A1-A30, further comprising a housing at least partially enclosing the foot member and the selector mechanism.

A32. The pedal assembly according to paragraph A31, wherein the housing comprises a first portion movable relative to a second portion of the housing.

A33. The pedal assembly according to paragraph A31 or A32, wherein the actuator is configured to lift a portion of the housing when the selector platform is moved between the first and second positions.

A34. The pedal assembly according to any of paragraphs A31-A33, wherein at least a portion of the actuator projects from the housing.

A35. The pedal assembly according to any of paragraphs A31-A34, further comprising an indicator configured to provide visual feedback of a selected position.

A36. The pedal assembly according to paragraph A35, wherein at least a portion of the indicator is incorporated in the housing.

A37. The pedal assembly according to any of paragraphs A29-A36, further comprising a guide plate configured to guide a movement of the actuator.

A38. The pedal assembly according to paragraph A37, wherein the guide plate comprises a slot and wherein the actuator passes through the slot.

A39. The pedal assembly according to any of paragraphs A35-A38, wherein the indicator is provided, at least partially, on the guide plate.

A40. The pedal assembly according to any of paragraphs A1-A39, wherein the foot member is a footplate.

A41. An exercise machine comprising: a frame including a base for contacting a support surface; a drive assembly connected to the base; first and second reciprocating assemblies operatively coupled to the drive assembly and the frame, each of the first and second reciprocating assemblies comprising a pedal assembly according to any of paragraphs A1-A40.

A42. The exercise machine according to paragraph A41, wherein the exercise machine is an elliptical trainer.

A43. The exercise machine according to paragraph A42, wherein the drive assembly comprises a crank shaft located forward of the pedals.

B1. An exercise machine comprising: a frame including a base for contacting a support surface; a drive assembly operatively associated with the frame; first and second reciprocating assemblies operatively coupled to the drive assembly and the frame, each of the first and second reciprocating assemblies comprising: a foot link; a pedal pivotally connected to the foot link; and a selector mechanism operatively coupled to the pedal and configured to adjust the pedal from a first configuration in which the pedal is supported by at least one resilient member to a second configuration in which the pedal is not supported by the at least one resilient member.

B2. The exercise machine according to paragraph B1, wherein the exercise machine is an elliptical trainer.

B3. The exercise machine according to paragraph B1 or B2, wherein the drive assembly comprises a crank shaft located forward of the pedals.

Although the examples herein are described with reference to an elliptical machine, pedal assemblies in accordance with the present disclosure may be used with other exercise machines such as stair climbers, stationary bicycles, or others. Of course, it is to be appreciated that any one of the above embodiments or processes may be combined with one or more other embodiments and/or processes or be separated and/or performed amongst separate devices or device portions in accordance with the present systems, devices and methods. The description of exemplary embodiments is intended to be merely illustrative of examples in accordance with the present disclosure and should not be construed as limiting the appended claims to any particular embodiment or group of embodiments. Thus, while examples have been described in particular detail with reference to exemplary embodiments, it should also be appreciated that numerous modifications and alternative embodiments may be devised by those having ordinary skill in the art without departing from the broader and intended spirit and scope of the present disclosure as set forth in the claims that follow. Accordingly, the specification and drawings are to be regarded in an illustrative manner and are not intended to limit the scope of the appended claims.

What is claimed is:

1. A pedal assembly for an exercise machine, the pedal assembly comprising:

a foot link;

a foot member pivotally connected to the foot link;

a support member positioned between the foot member and the foot link;

a selector mechanism movable with respect to the foot member at least between a first position in which the foot member is supported by the support member and a second position in which the foot member is not supported by the support member.

2. The pedal assembly of claim 1, wherein the selector mechanism comprises a selector platform configured to move in a plane to position the selector platform between the first position and the second position.

3. The pedal assembly of claim 2, wherein the selector platform is pivotally coupled to the foot member.

4. The pedal assembly of claim 2, wherein the selector platform comprises a contact side positioned to at least partially contact the foot member during at least a portion of a stroke of the pedal assembly, and an engagement side in contact with the support member when the selector platform is in the first position.

5. The pedal assembly of claim 4, wherein the engagement side comprises one or more engagement features configured to resist relative movement between the selector platform and the support member.

6. The pedal assembly of claim 5, comprising a plurality of springs, and wherein the support member is one of the plurality of springs.

7. The pedal assembly of claim 6, wherein the plurality of springs comprises a first spring and a second spring stiffer than the first spring.

8. The pedal assembly of claim 1, wherein the support member is formed of resilient material.

9. The pedal assembly of claim 6, wherein the plurality of springs comprises a first spring and a second spring, and wherein the one or more engagement features comprise a first seat to resist relative movement between the first spring and the selector platform when the selector platform is in the first position.

10. The pedal assembly of claim 9, wherein the selector platform is configured such that the foot member is not supported by the second spring when the selector platform is in the first position.

11. The pedal assembly of claim 9, further comprising a second seat configured to resist relative movement between the second spring and the selector platform when the selector mechanism is in a third position.

12. The pedal assembly of claim 6, wherein the engagement side comprises a first region configured to engage only one spring of the plurality of springs and a second region configured to engage only another one of the plurality of springs.

13. The pedal assembly of claim 4, wherein the support member is a first resilient member, the pedal assembly further comprising a second resilient member, and wherein the engagement side comprises a first engagement sector including engagement features to resist relative movement between the selector platform and the first resilient member, the second resilient member, or both.

14. The pedal assembly of claim 13, wherein the first engagement sector corresponds to the first position, and the pedal assembly further comprises a second engagement sector corresponding to a third position in which the selector platform contacts the first resilient member, the second resilient member, or both.

15. The pedal assembly of claim 6, wherein the plurality of springs is connected to a support structure below the foot member.

16. The pedal assembly of claim 15, wherein the plurality of springs is removably connected to the support structure.

17. The pedal assembly of claim 15, wherein the support structure includes a base defining a plurality of holes sized for an interference fit with the plurality of springs.

18. The pedal assembly of claim 17, wherein the selector platform, the base, or both are made from a resilient material.

19. The pedal assembly of claim 15, further comprising a post positioned between the foot member and the support structure, wherein the foot member rests on the post when the selector platform is in the second position.

20. The pedal assembly of claim 19, wherein the selector platform comprises at least one registration hole configured to receive the post at least partially therein.

21. The pedal assembly of claim 20, wherein the selector platform is movable to a plurality of predetermined positions including the first and second positions, and wherein the selector platform further comprises a registration hole for each of the plurality of predetermined positions, the registration hole configured to receive, at least partially, therein the post.

22. The pedal assembly of claim 2, further comprising an actuator connected to the selector platform.

23. The pedal assembly of claim 1, further comprising a housing at least partially enclosing the foot member and the selector mechanism.

24. The pedal assembly of claim 23, wherein the housing comprises a first portion movable relative to a second portion of the housing.

25. The pedal assembly of claim 1, further comprising an indicator configured to provide visual feedback of a selected position.

* * * * *